US011619124B2

(12) United States Patent
Morrison et al.

(10) Patent No.: US 11,619,124 B2
(45) Date of Patent: Apr. 4, 2023

(54) SYSTEM AND METHODOLOGY TO IDENTIFY MILLING EVENTS AND PERFORMANCE USING TORQUE-THRUST CURVES

(71) Applicant: Schlumberger Technology Corporation, Sugar Land, TX (US)

(72) Inventors: Richard Morrison, Sugar Land, TX (US); Sascha Trummer, Richmond, TX (US); Luis Silva, Houston, TX (US); Zhanke Liu, Sugar Land, TX (US); Charles Kearney, Richmond, TX (US); Jordi Segura Dominguez, Richmond, TX (US); Santiago Hassig Fonseca, Quito (EC); Pierre Ramondenc, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 17 days.

(21) Appl. No.: 17/123,363

(22) Filed: Dec. 16, 2020

(65) Prior Publication Data

US 2021/0189864 A1 Jun. 24, 2021

Related U.S. Application Data

(60) Provisional application No. 62/951,186, filed on Dec. 20, 2019.

(51) Int. Cl.
*E21B 47/09* (2012.01)
*E21B 47/02* (2006.01)
(Continued)

(52) U.S. Cl.
CPC ..... *E21B 47/09* (2013.01); *E21B 17/206* (2013.01); *E21B 47/02* (2013.01); *E21B 47/12* (2013.01); *E21B 49/087* (2013.01)

(58) Field of Classification Search
CPC ..... E21B 29/00; E21B 47/12; E21B 47/09; E21B 49/087; E21B 47/02; E21B 44/06; E21B 44/00
See application file for complete search history.

(56) References Cited

U.S. PATENT DOCUMENTS 5,839,514 A 11/1998 Gipson
6,536,539 B2 3/2003 Merecka et al.
(Continued)

FOREIGN PATENT DOCUMENTS

EP 2773837 B1 10/2018
EP 2798150 B1 1/2019
(Continued)

OTHER PUBLICATIONS

Office Action issued in U.S. Appl. No. 16/878,762 dated Dec. 14, 2021, 14 pages.
(Continued)

*Primary Examiner* — Caroline N Butcher

(57) ABSTRACT

Systems and methods presented herein facilitate operation of well-related tools. In certain embodiments, a variety of data (e.g., downhole data and/or surface data) may be collected to enable optimization of operations related to the well-related tools. In certain embodiments, the collected data may be provided as advisory data (e.g., presented to human operators of the well to inform control actions performed by the human operators) and/or used to facilitate automation of downhole processes and/or surface processes (e.g., which may be automatically performed by a computer implemented surface processing system (e.g., a well control system), without intervention from human operators). In
(Continued)

certain embodiments, the systems and methods described herein may enhance downhole operations (e.g., milling operations) by improving the efficiency and utilization of data to enable performance optimization and improved resource controls of the downhole operations.

21 Claims, 16 Drawing Sheets

(51) Int. Cl.

| | |
|---|---|
| ***E21B 17/20*** | (2006.01) |
| ***E21B 49/08*** | (2006.01) |
| ***E21B 47/12*** | (2012.01) |

(56) References Cited

U.S. PATENT DOCUMENTS

| | | | |
|---|---|---|---|
| 6,923,273 | B2 | 8/2005 | Terry et al. |
| 9,797,235 | B2 | 10/2017 | Ringer et al. |
| 10,260,331 | B2 | 4/2019 | Viens et al. |
| 10,753,163 | B2 | 8/2020 | Dobkins et al. |
| 11,168,559 | B2 | 11/2021 | Dobkins et al. |
| 2011/0153296 | A1 | 6/2011 | Sadlier et al. |
| 2011/0174541 | A1 | 7/2011 | Strachan et al. |
| 2011/0280104 | A1 | 11/2011 | McClung |
| 2013/0056223 | A1 | 3/2013 | Nichols |
| 2015/0247396 | A1 | 9/2015 | Tunc et al. |
| 2016/0115776 | A1 | 4/2016 | Haci |
| 2017/0122076 | A1 | 5/2017 | Curry et al. |
| 2017/0145760 | A1 | 5/2017 | Poyet et al. |
| 2017/0183930 | A1 | 6/2017 | Livescu et al. |
| 2017/0321547 | A1* | 11/2017 | Enkababian ..... E21B 29/002 |
| 2018/0266234 | A1 | 9/2018 | Witte et al. |
| 2018/0334903 | A1* | 11/2018 | Lehr ..... E21B 33/12 |
| 2019/0345779 | A1 | 11/2019 | Kennedy et al. |
| 2020/0277841 | A1* | 9/2020 | Olliff ..... E21B 41/0092 |
| 2020/0370379 | A1 | 11/2020 | Morrison et al. |

FOREIGN PATENT DOCUMENTS

| | | | |
|---|---|---|---|
| WO | 2008039411 | A2 | 4/2008 |
| WO | 2017062329 | A1 | 4/2017 |
| WO | 2017156111 | A1 | 9/2017 |
| WO | 2020236876 | A1 | 11/2020 |

OTHER PUBLICATIONS

International Search Report and Written Opinion issued in International Patent application PCT/US2020/033709 dated Sep. 1, 2020, 12 pages.

International Preliminary Report on Patentability issued in International Patent application PCT/US2020/033709, dated Dec. 2, 2021, 11 pages.

Office Action issued in U.S. Appl. No. 16/878,762 dated Jul. 19, 2022, 15 pages.

* cited by examiner

SYSTEM AND METHODOLOGY TO IDENTIFY MILLING EVENTS AND PERFORMANCE USING TORQUE-THRUST CURVES

CROSS-REFERENCES TO RELATED APPLICATIONS

This application claims priority to and the benefit of U.S. Provisional Patent Application Ser. No. 62/951,186, entitled "System and Methodology to Identify Milling Events and Performance using Torque-Thrust Curves," filed Dec. 20, 2019, which is hereby incorporated by reference in its entirety for all purposes.

BACKGROUND

The present disclosure generally relates to systems and methods for controlling operational parameters during mill-out operations and, more particularly, to the control of flow rate and pressure during coiled tubing mill-out operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

With respect to milling operations, coiled tubing may be used in plug milling following hydraulic fracturing operations. The coiled tubing may be used to deliver a bottom hole assembly and a corresponding milling tool downhole to enable milling of multiple plugs along, for example, lateral wellbores of 10,000 feet or more. However, current approaches to milling operations can be inefficient and rely on insufficient data for ensuring performance optimization and resource controls.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes deploying a downhole well tool into a wellbore of a well via coiled tubing. The method also includes detecting one or more surface parameters via one or more surface sensors associated with surface equipment located at a surface of the well. The method further includes processing, via a surface processing system, the one or more surface parameters during operation of the downhole well tool to enable automatic adjustment of one or more operational parameters of the surface equipment based at least in part on the one or more surface parameters.

In addition, certain embodiments of the present disclosure include a surface processing system that includes one or more non-transitory computer-readable storage media storing instructions which, when executed, cause at least one processor to perform operations. The operations include receiving one or more surface parameters detected by one or more surface sensors associated with surface equipment located at a surface of a well. The operations also include processing the one or more surface parameters during operation of a downhole well tool deployed in a wellbore of the well via coiled tubing to enable automatic adjustment of one or more operational parameters of the surface equipment based at least in part on the received one or more surface parameters.

In addition, certain embodiments of the present disclosure include a method that includes deploying a downhole well tool into a wellbore of a well via coiled tubing. The method also includes collecting downhole measurements via one or more downhole sensors associated with the downhole well tool. The method further includes processing, via a surface processing system, the downhole measurements during operation of the downhole well tool to identify a signal of interest from the collected downhole measurements, and to indicate a new formation zone based at least in part on the identified signal of interest.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
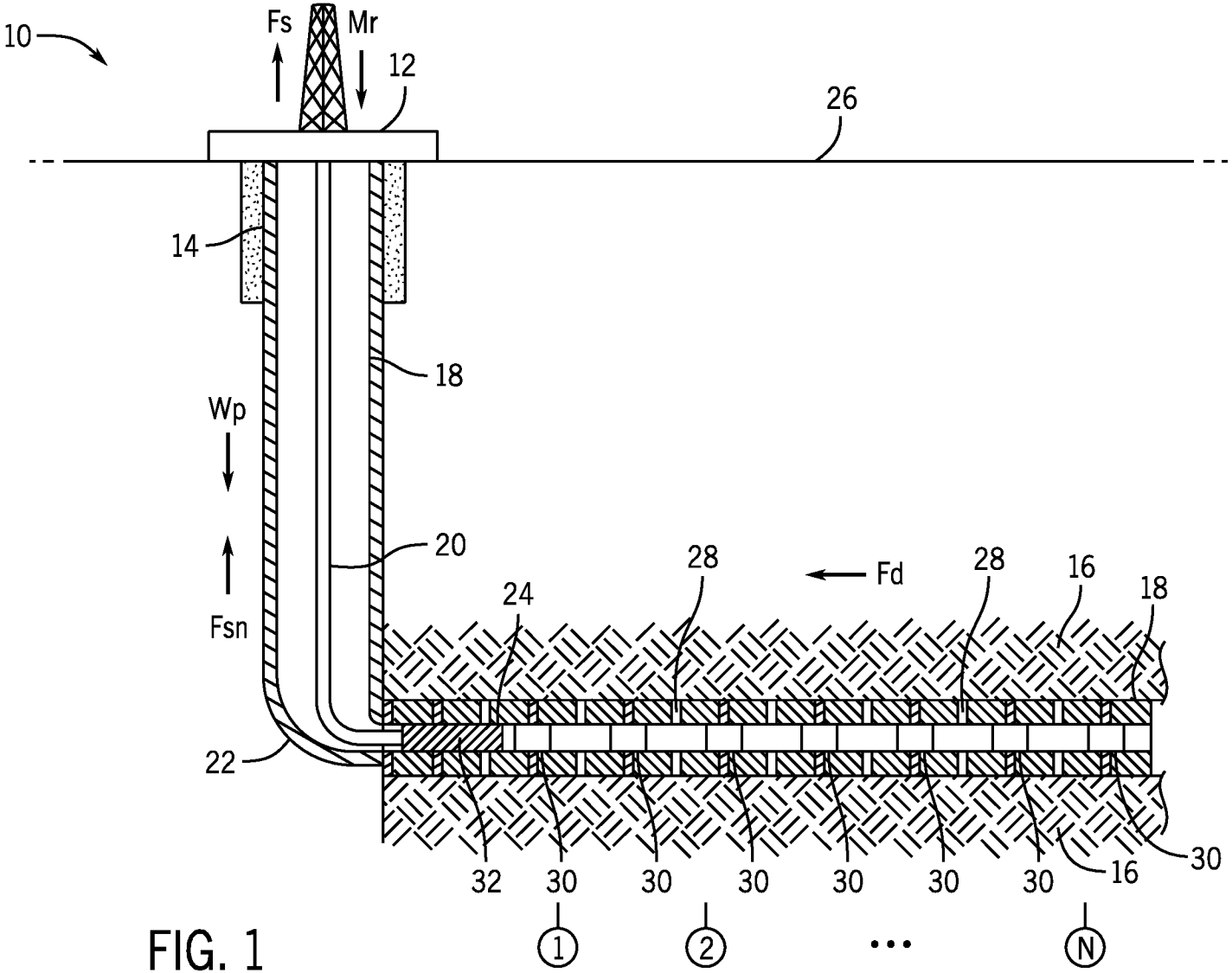
FIGS. 1 and 2 are schematic illustrations of an oilfield well that traverses a hydraulically-fractured hydrocarbon-bearing reservoir as well as a downhole well tool for milling out plugs that isolate a number of intervals offset from one another along the length of the well, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, a fracture shall be understood as one or more cracks or surfaces of breakage within rock. Fractures can enhance permeability of rocks greatly by connecting pores together and, for that reason, fractures can be induced mechanically in some reservoirs in order to boost hydrocarbon flow. Certain fractures may also be referred to as natural fractures to distinguish them from fractures induced as part of a reservoir stimulation. Fractures can also be grouped into fracture clusters (or "perf clusters") where the fractures of a given fracture cluster (perf cluster) connect to the wellbore through a single perforated zone. As used herein, the term "fracturing" refers to the process and methods of breaking down a geological formation and creating a fracture (i.e., the rock formation around a well bore) by pumping fluid at relatively high pressures (e.g., pressure above the determined closure pressure of the formation) in order to increase production rates from a hydrocarbon reservoir.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention).

The embodiments described herein generally include systems and methods that facilitate operation of well-related tools. In certain embodiments, a variety of data (e.g., downhole data and/or surface data) may be collected to enable optimization of operations related to the well-related tools. In certain embodiments, the collected data may be provided as advisory data (e.g., presented to human operators of the well to inform control actions performed by the human operators) and/or used to facilitate automation of downhole processes and/or surface processes (e.g., which may be automatically performed by a computer implemented surface processing system (e.g., a well control system), without intervention from human operators). In certain embodiments, the systems and methods described herein may enhance downhole operations (e.g., milling operations) by improving the efficiency and utilization of data to enable performance optimization and improved resource controls of the downhole operations. In certain embodiments, a well tool may be deployed downhole into a wellbore via coiled tubing. In certain embodiments, the well tool may be in the form of a milling tool that may be used to mill out plugs or other downhole equipment. However, it will be appreciated that the systems and methods described herein also may be used for displaying or otherwise outputting desired (e.g., optimal) actions to human operators so as to enable improved decision-making regarding operation of the well tool (e.g., operation of a downhole or surface system/device).

In certain embodiments, downhole parameters are obtained via, for example, downhole sensors while the well tool is disposed in the wellbore. In certain embodiments, the downhole parameters may be obtained by the downhole sensors in substantially real time (e.g., as the downhole data is detected while the downhole well tool is being operated), and sent to the surface processing system (or other suitable processing system) via wired or wireless telemetry. The downhole parameters may be combined with surface parameters. In certain embodiments, the downhole and/or surface parameters may be processed during operation of the well tool downhole to enable automatic optimization (e.g., by the surface processing system, without human intervention) with respect to the operation of the well tool during subsequent stages of well tool operation. Examples of subsequent stages of well tool operation include milling of subsequent plugs disposed along a wellbore.

Furthermore, examples of downhole parameters that may be sensed in substantially real time (e.g., as the data is sensed while the downhole well tool is being operated) may include weight on bit (WOB), torque acting on the well tool, pressures, differential pressures, and other desired downhole parameters. In certain embodiments, the downhole parameters may be used in combination with surface parameters, and such surface parameters may include pump-related parameters (e.g., pump rate and circulating pressures). It should be noted that, in certain embodiments, pumps may be used to drive the downhole well tool. For example, a downhole milling tool may include a milling bit driven by a hydraulic motor.

In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from a coiled tubing unit (e.g., surface weight of the coiled tubing string, speed of the coiled tubing, rate of penetration, and other desired parameters). In certain embodiments, the surface data that is processed to optimize performance also may include previously recorded data such as fracturing data (e.g., close in pressures from each fracturing stage, proppant data, friction data, fluid volume data, and other desired data). In certain embodiments, desired combinations of downhole data and surface data may be combined to enhance, and to automate the downhole process, in certain embodiments.

Depending on the type of downhole operation, in certain embodiments, the downhole data and/or the surface data may be combined to prevent stalls and to facilitate stall recovery with respect to the downhole well tool. Appropriate processing of the downhole and/or the surface data by the surface processing system also facilitates cooperative operation of the coiled tubing unit, pumps, and flow back equipment described herein. This cooperation provides synergy that facilitates output of advisory information and/or automation of the downhole processes (e.g., milling processes) as well as appropriate adjustment of the rate of penetration (ROP) and pump rates for each individual stage of the operation. In a milling operation, for example, the individual stages may correspond with milling of each individual plug based on the surface data and/or the downhole data obtained in substantially real time. It should be noted that the data (e.g., the downhole data and/or the surface data) also may be used to provide advisory information and/or automation of surface processes such as pumping processes.

In some applications, use of this data enables the surface processing system to self-learn to provide, for example, optimum downhole WOB and torque for milling each subsequent plug in an efficient manner. This real-time modeling, based on the downhole and/or surface parameters, enables improved prediction of WOB, torque, and pressure differential for each plug after the plug most recently milled. Such modeling also enables the milling process (or other downhole process) to be automated and automatically optimized, in certain embodiments. In certain embodiments, the downhole parameters also may be used to predict motor or mill wear and to advise as to timing of the next trip to the surface for replacement of the motors and/or mills.

In certain embodiments, the downhole parameters (as well as the a priori data described herein, in certain embodiments) also enable use of pressures below each milled plug to be used by the surface processing system to characterize the reservoir. Such real-time downhole parameters also enable use of pressures below each milled plug for in situ evaluation, advisory of post-fracturing flow back parameters, and for creating an optimum flow back schedule for maximized production of, for example, hydrocarbon fluids from the surrounding reservoir. In particular, because a large number of plugs (e.g., 40-80 plugs) may be milled out of any given well, there are many opportunities to use the detected downhole parameters (as well as the a priori data) described herein to periodically characterize the reservoir surrounding the given well. For example, in certain embodiments, the formation pressure detected downhole for each respective milled plug may provide additional insight into the efficacy of the fracturing performed near the respective milled plug, the data for which may be collected for a plurality of milled plugs, thereby enabling characterization of the surrounding reservoir. In certain embodiments, the data available from a given well may be utilized in designing the next fracturing schedule for the same pad/neighbor wells as well as for plug milling predictions regarding subsequent wells.

Certain systems and methods have been used to characterize formation pressure in the past. For example, certain systems and methods for characterizing hydraulically-fractured hydrocarbon-bearing formations analyze flow characteristics of return fluid that flows from an interval back to a surface-located facility during well operations, and characterize at least one formation property of the fractured formation adjacent the interval. The embodiments described herein overcome disadvantages and shortcomings of existing systems and methods. For example, the embodiments described herein facilitate the control of downhole and surface pressures and flow rates during coiled tubing milling operations by, for example, orchestration of the pump and flowback controls, and further optimization via substantially real-time downhole and/or surface measurements. For example, in certain embodiments, pressure and flow rate measurements at both the pumps and flowback equipment, in addition to integrated choke control and pump controls, may be used by the surface processing system described herein (e.g., including programmable logic controllers (PLCs)).

Figure 2:
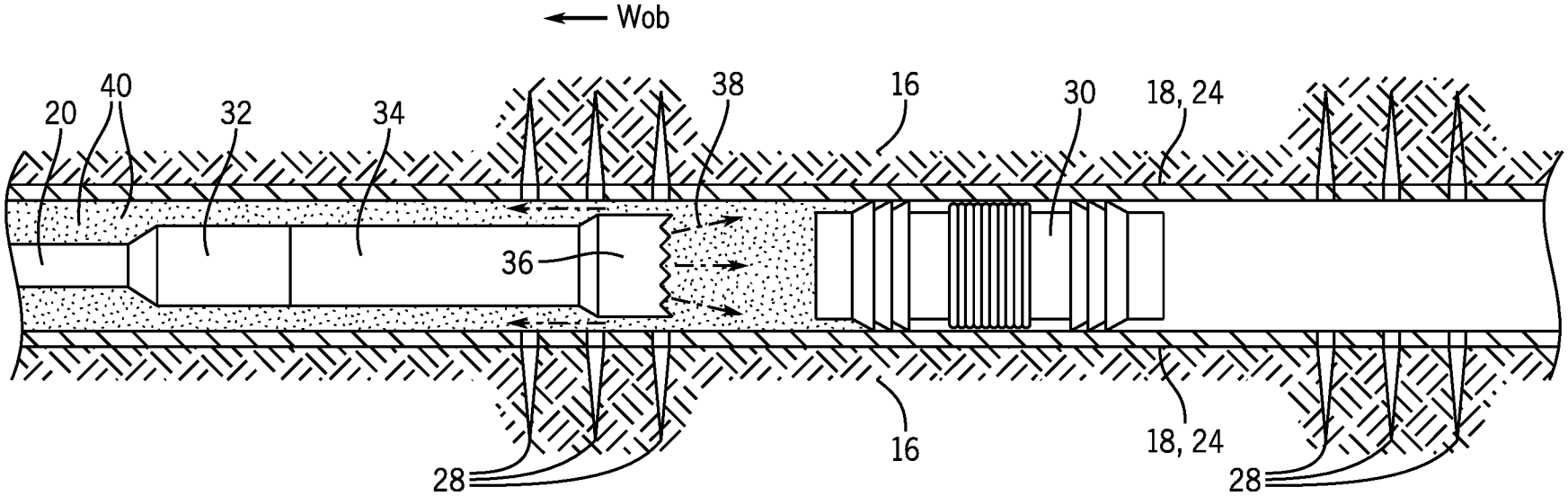
Figure 3:
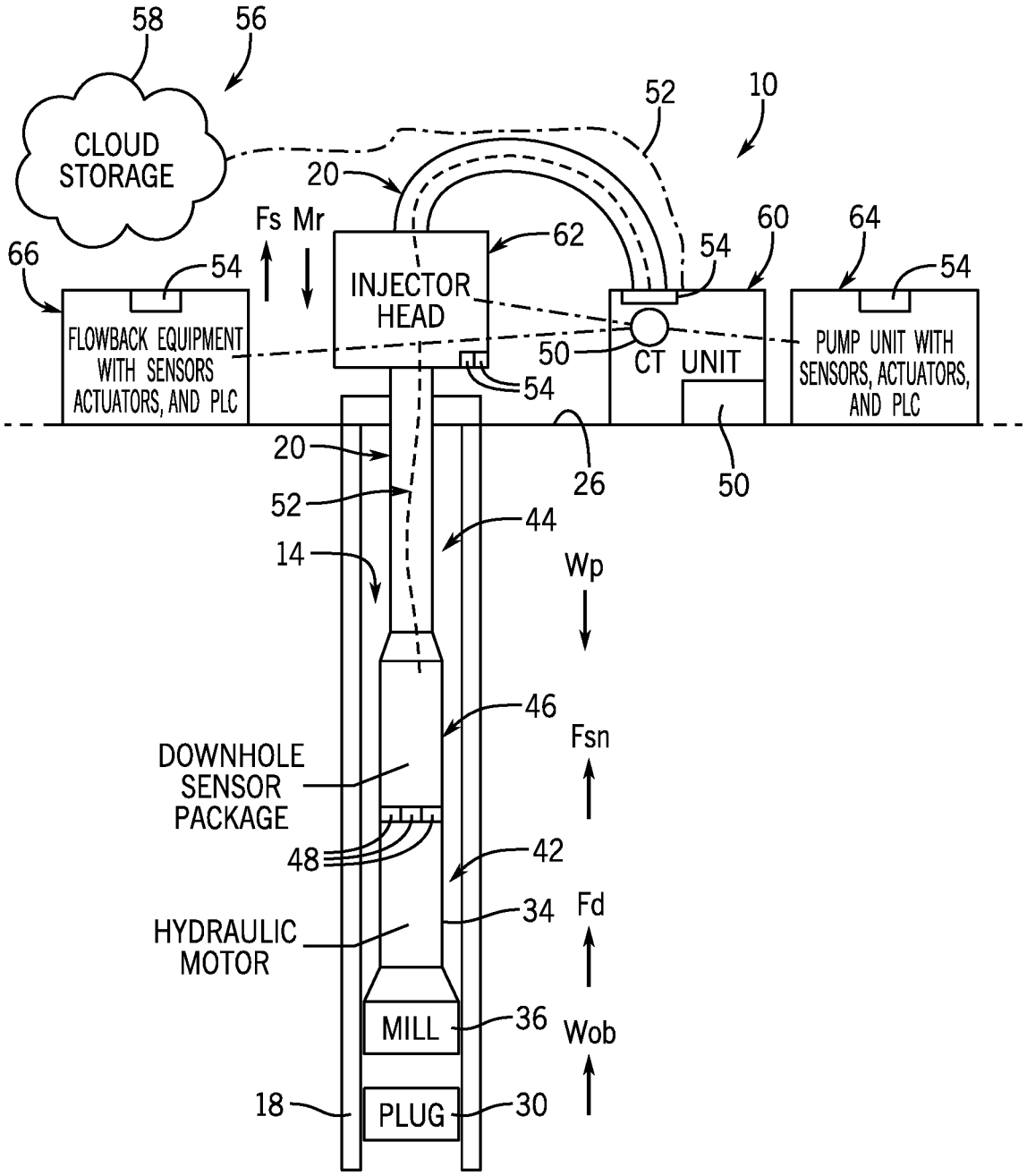
FIG. 3 is a schematic illustration of a well system that obtains sensor data to dynamically update information related to operation and control of a downhole well tool, in accordance with embodiments of the present disclosure.

With the foregoing in mind, FIGS. 1 and 2 are schematic illustrations of an example well system 10 that has undergone perforation and fracturing applications. As illustrated, in certain embodiments, a platform and derrick 12 may be positioned over a wellbore 14 that traverses a hydrocarbon-bearing reservoir 16 by rotary drilling. While certain elements of the well system 10 are illustrated in FIGS. 1 and 2, other elements of the well (e.g., blow-out preventers, wellhead "tree", etc.) have been omitted for clarity of illustration. In certain embodiments, the well system 10 includes an interconnection of pipes, including vertical and horizontal casing 18, tubing 20 (e.g., coiled tubing), transition 22, and a production liner 24 that connect to a surface facility (as illustrated in FIG. 3) at the surface 26 of the well system 10. In certain embodiments, the tubing 20 extends inside the casing 18 and terminates at a tubing head (not shown) at or near the surface 26. In addition, in certain embodiments, the casing 18 contacts the wellbore 14 and terminates at a casing head (not shown) at or near the surface 26. In certain embodiments, the production liner 24 and/or the horizontal casing 18 have aligned radial openings termed "perforation zones" 28 that allow fluid communication between the production liner 24 and the hydraulically fractured hydrocarbon-bearing reservoir or formation 16.

In certain embodiments, a number of plugs 30 may be disposed in the well system 10 at positions offset from one another along the longitudinal length of the wellbore 14 in order to provide hydraulic isolation between certain intervals of the well system 10 with a number of perforation zones 28 in each interval. In certain embodiments, each plug 30 may include one or more expanding slips and seal members for anchoring and sealing the plug 30 to the production liner 24 or the casing 18. In addition, in certain embodiments, each plug 30 may be formed primarily from composite materials (or other suitable materials) that enables the plug 30 to be milled-out for removal as described in greater detail herein.

In certain embodiments, a bottom hole assembly ("BHA") 32 may be run inside the casing 18 by the tubing 20 (which may be coiled tubing or drill pipe). As illustrated in FIG. 2, in certain embodiments, the BHA 32 may include a downhole motor 34 that operates to rotate a milling tool 36. In certain embodiments, the downhole motor 34 may be driven by hydraulic forces carried in milling fluid supplied from the surface 26 of the well system 10. In certain embodiments, the BHA 32 may be connected to the tubing 20, which is used to run the BHA 32 to a desired location within the wellbore 14. It is also contemplated that, in certain embodiments, the rotary motion of the milling tool 36 may be driven by rotation of the tubing 20 effectuated by a rotary table or other surface-located rotary actuator. In such embodiments, the downhole motor 34 may be omitted.

In certain embodiments, the tubing 20 may also be used to deliver milling fluid (arrows 38) to the milling tool 36 to aid in the milling process and carry cuttings and possibly other fluid and solid components in fluid 40 (referred to herein as "return fluid") that flows up the annulus between the tubing 20 and the casing 18 (or via a return flow path provided by the tubing 20, in certain embodiments) for return to the surface facility (as illustrated in FIG. 3). In certain embodiments, the BHA 32 may be located such that the milling tool 36 is positioned in direct contact with a plug 30. In such embodiments, the rotary motion of the milling tool 36 mills away the plug 30 into cuttings that flow as part of the return fluid 40 that is returned to the surface facility (as illustrated in FIG. 3). It is also contemplated that the return fluid 40 may include remnant proppant (e.g., sand) or possibly rock fragments that result from the hydraulic fracturing application, and flow within the well system 10 during the plug mill-out process. After the plug 30 is removed by the milling, a flow path is opened past the drill plug. Under certain conditions, fracturing fluid and possibly hydrocarbons (oil and/or gas), proppants and possibly rock fragments may flow from the fractured reservoir 16 through the perforations 28 in the newly opened interval and back to the surface 26 of the well system 10 as part of the return fluid 40. In certain embodiments, the BHA 32 may be supplemented behind the rotary drill by an isolation device such as, for example, an inflatable packer that may be activated to isolate the zone below or above it, and enable local pressure tests.

FIG. 3 is a schematic illustration of the well system 10 of FIGS. 1 and 2. As illustrated in FIG. 3, in certain embodiments, the well system 10 may include a downhole well tool 42 that is moved along the wellbore 14 via coiled tubing 20. In certain embodiments, the downhole well tool 42 may include a variety of drilling/cutting tools coupled with the coiled tubing 20 to provide a coiled tubing string 44. In the illustrated embodiment, the downhole well tool 42 includes a milling tool 36, which may be powered by a motor 34 (e.g., a positive displacement motor (PDM), or other hydraulic motor). In certain embodiments, the milling tool 36 may be used to mill out a plug 30 or plugs 30 disposed along the wellbore 14. Although described primarily herein as relating to embodiments for milling out plugs 30, in other embodiments, other type of milling targets may be milled out, such as cement, obstructions along the wellbore 14, naturally occurring obstructions such as deposits from formation fluid or injected fluid, objects left in the wellbore 14 from previous operations, warped or deformed completion tubulars, and so forth. In certain embodiments, the wellbore 14 may be an open wellbore or a cased wellbore defined by a casing 18. As described herein, in certain embodiments, the wellbore 14 may be vertical or horizontal or inclined. It should be noted the downhole well tool 42 may be part of various types of BHAs 32 coupled to the coiled tubing 20. In certain embodiments, the plug(s) 30 may be disposed along the wellbore 14 within a downhole completion.

Particularly, in certain embodiments, the plug(s) 30 may be disposed along a horizontal section of the wellbore 14. Once delivered in place, such plug(s) 30 may be anchored and sealed against the casing 18. Once anchored and sealed, perforation may be applied above the plug 30 through the casing 18, as illustrated in FIG. 2. The perforation application may be followed by hydraulic applications to direct high pressure fracturing fluid through the casing perforations 28 into the adjacent formation 16, to cause fracturing of reservoir rock for easier production. Typical hydraulic fracturing fluid may contain other substances such as proppant, sand, fiber, etc., to keep the fractures open after the completion of hydraulic fracturing. The placement, anchoring, perforation, and fracturing process may be repeated by moving from downhole to uphole interval by interval, until the entire formation and production zone are treated as designed.

Upon completion and treatment, such plugs 30 may be removed before producing the well. In general, removal of such plugs 30 requires milling out operations, usually by coiled tubing 20. To improve the efficacy of plug mill-outs, in certain embodiments, the well system 10 also may include a downhole sensor package 46 having a plurality of downhole sensors 48. In certain embodiments, the sensor package 46 may be mounted along the coiled tubing string 44, although certain downhole sensors 48 may be positioned at other downhole locations in other embodiments. In certain embodiments, data from the downhole sensors 48 may be relayed uphole to a surface processing system 50 (e.g., a computer-based processing system) disposed at the surface 26 and/or other suitable location of the well system 10.

In certain embodiments, the data may be relayed uphole in substantially real time (e.g., relayed while it is detected by the downhole sensors 48 during operation of the downhole well tool 42) via a wired or wireless telemetric control line 52, and this real-time data may be referred to as edge data. For example, in certain embodiments, during a milling operation, the real-time data may be in the form of torque data (e.g., torque applied by the downhole hydraulic motor 34) and thrust data (e.g., weight on bit with respect to a milling bit). In certain embodiments, the torque data and thrust data may be combined to establish torque-thrust curves that, in turn, may be used to determine various parameters related to certain plugs 30 or other targets and/or operation of the milling tool 36. In certain embodiments, the telemetric control line 52 may be in the form of an electrical line, fiber-optic line, or other suitable control line for transmitting data signals. In certain embodiments, the telemetric control line 52 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 54 and/or stored in memory locations 56. By way of example, historical data and other useful data may be stored in a memory location 56 such as cloud storage 58.

As illustrated, in certain embodiments, the coiled tubing 20 may deployed by a coiled tubing unit 60 and delivered downhole via an injector head 62. In certain embodiments, the injector head 62 may be controlled to slack off or pick up on the coiled tubing 20 so as to control the tubing string weight and, thus, the weight on bit (WOB) acting on the bit of the milling tool 36 (or other downhole well tool 42).

In certain embodiments, fluid 38 may be delivered downhole under pressure from a pump unit 64. In certain embodiments, the fluid 38 may be delivered by the pump unit 64 through the downhole hydraulic motor 34 to power the downhole hydraulic motor 34 and, thus, the milling tool 36. In certain embodiments, the fluid 40 is returned uphole, and this flow back of fluid is controlled by suitable flow back equipment 66. In certain embodiments, the flow back equipment 66 may include chokes and other components/equipment used to control flow back of the return fluid 40 in a variety of applications, including well treatment applications.

In certain embodiments, the downhole well tool 42 may be moved along the wellbore 14 via the coiled tubing 20 under control of the injector head 62 so as to apply a desired tubing weight and, thus, to achieve a desired rate of penetration (ROP) as the milling tool 36 is operated to mill through the plugs 30. In certain embodiments, the controlled movement of the well tool 42 via the coiled tubing 20 may be used in a variety of applications other than milling out plugs 30. Depending on the specifics of a given application, various types of data may be collected downhole, and transmitted to the surface processing system 50 in substantially real time to facilitate improved operation of the downhole well tool 42. For example, the data may be used to fully or partially automate the downhole operation, to optimize the downhole operation, and/or to provide more accurate predictions regarding components or aspects of the downhole operation.

As described in greater detail herein, the pump unit 64 and the flowback equipment 66 may include advanced sensors, actuators, and local controllers, such as PLCs, which may cooperate together to provide sensor data to, receive control signals from, and generate local control signals based on communications with, respectively, the surface processing system 50. In certain embodiments, as described in greater detail herein, the sensors may include flow rate, pressure, and fluid rheology sensors, among other types of sensors. In addition, as described in greater detail herein, the actuators may include actuators for pump and choke control of the pump unit 64 and the flowback equipment 66, respectively, among other types of actuators.

Figure 4:
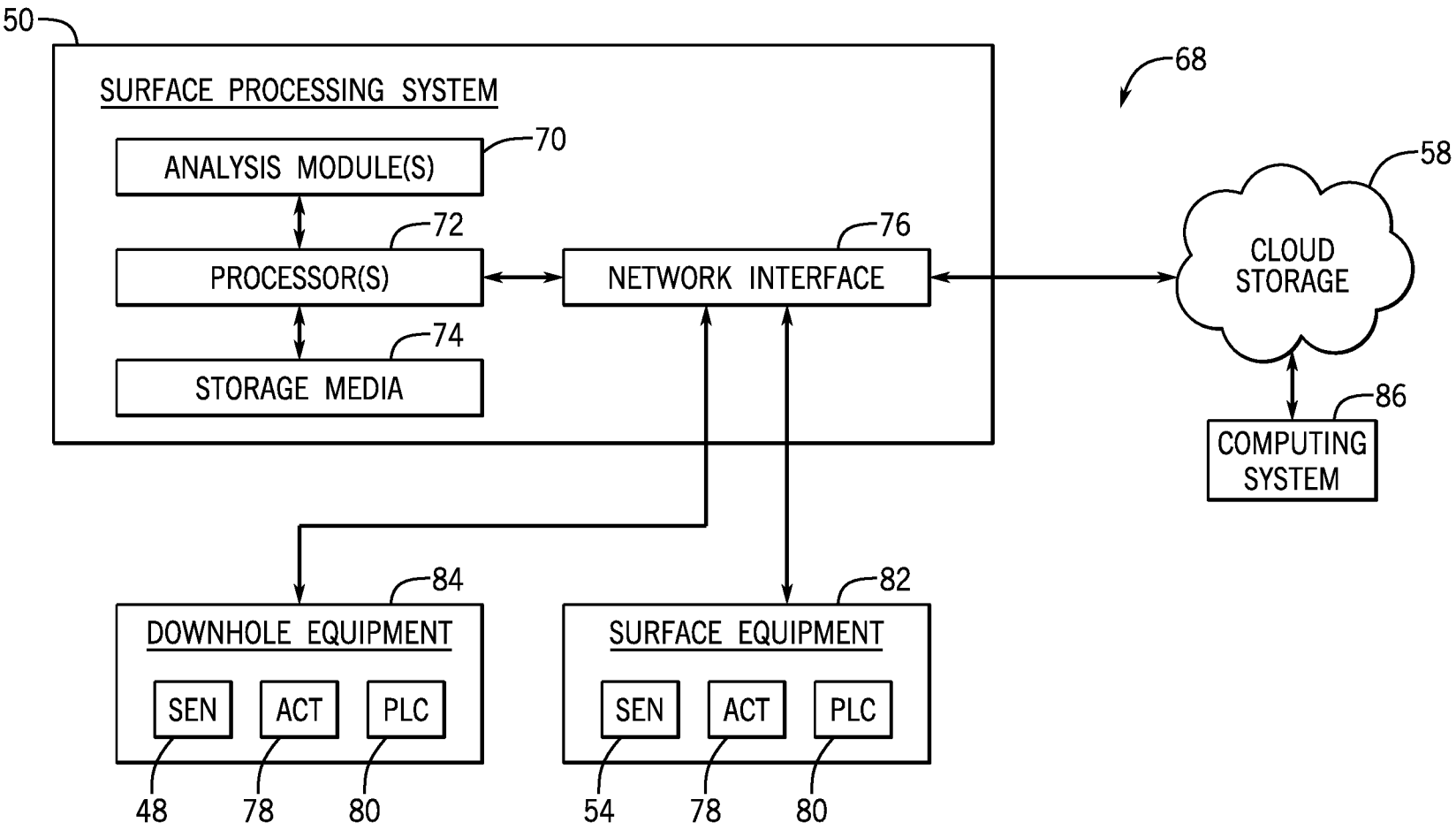
FIG. 4 illustrates a well control system that may include a surface processing system to control the well system described herein, in accordance with embodiments of the present disclosure.

FIG. 4 illustrates a well control system 68 that may include the surface processing system 50 to control the well system 10 described herein. In certain embodiments, the surface processing system 50 may include one or more analysis modules 70 (e.g., a program of computer-executable instructions and associated data) that may be configured to perform various functions of the embodiments described herein. In certain embodiments, to perform these various functions, an analysis module 70 executes on one or more processors 72 of the surface processing system 50, which may be connected to one or more storage media 74 of the surface processing system 50. Indeed, in certain embodiments, the one or more analysis modules 70 may be stored in the one or more storage media 74.

In certain embodiments, the one or more processors 72 may include a microprocessor, a microcontroller, a processor module or subsystem, a programmable integrated circuit, a programmable gate array, a digital signal processor (DSP), or another control or computing device. In certain embodiments, the one or more storage media 74 may be implemented as one or more non-transitory computer-readable or machine-readable storage media. In certain embodiments, the one or more storage media 74 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 70 may be provided on one computer-readable or machine-readable storage medium of the storage media 74, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 74 may be located either in the machine running the machine-readable instructions, or may be located at a remote site from which machine-readable instructions may be downloaded over a network for execution.

In certain embodiments, the processor(s) 72 may be connected to a network interface 76 of the surface processing system 50 to allow the surface processing system 50 to communicate with the various downhole sensors 48 and surface sensors 54 described herein, as well as communicate with the actuators 78 and/or PLCs 80 of the surface equipment 82 (e.g., the coiled tubing unit 60, the pump unit 64, the flowback equipment 66, and so forth) and of the downhole equipment 84 (e.g., the BHA 32, the downhole motor 34, the milling tool 36, the downhole well tool 42, and so forth) for the purpose of controlling operation of the well system 10, as described in greater detail herein. In certain embodiments, the network interface 76 may also facilitate the surface processing system 50 to communicate data to cloud storage 58 (or other wired and/or wireless communication network) to, for example, archive the data or to enable external computing systems 86 to access the data and/or to remotely interact with the surface processing system 50.

It should be appreciated that the well control system 68 illustrated in FIG. 4 is only one example of a well control system, and that the well control system 68 may have more or fewer components than shown, may combine additional components not depicted in the embodiment of FIG. 4, and/or the well control system 68 may have a different configuration or arrangement of the components depicted in FIG. 4. In addition, the various components illustrated in FIG. 4 may be implemented in hardware, software, or a combination of both hardware and software, including one or more signal processing and/or application specific integrated circuits. Furthermore, the operations of the well control system 68 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 42 illustrated in FIG. 3 by the surface processing system 50 illustrated in FIG. 4 (or other suitable processing system). In certain embodiments, the data may be provided as advisory data by the surface processing system 50 (or other suitable processing system). However, in other embodiments, the data may be used to facilitate automation of downhole processes and/or surface processes (i.e., the processes may be automated without human intervention), as described in greater detail herein, by the surface processing system 50 (or other suitable processing system). The embodiments described herein may enhance downhole operations (e.g., milling operations) by improving the efficiency and utilization of data to enable performance optimization and improved resource controls.

As described in greater detail herein, in certain embodiments, downhole parameters may be obtained via, for example, downhole sensors 48 while the downhole well tool 42 is disposed within the wellbore 14. In certain embodiments, the downhole parameters may be obtained in substantially real-time and sent to the surface processing system 50 via wired or wireless telemetry. In certain embodiments, downhole parameters may be combined with surface parameters by the surface processing system 50. In certain embodiments, the downhole and surface parameters may be processed by the surface processing system 50 during use of the downhole well tool 42 to enable automatic (e.g., without human intervention) optimization with respect to use of the downhole well tool 42 during subsequent stages of operation of the downhole well tool 42. Examples of subsequent stages of operation of the downhole well tool 42 include, but are not limited to, milling of subsequent plugs 30 disposed along a wellbore 14.

Examples of downhole parameters that may be sensed in real time include, but are not limited to, weight on bit (WOB), torque acting on the downhole well tool 42, downhole pressures, downhole differential pressures, and other desired downhole parameters. In certain embodiments, downhole parameters may be used by the surface processing system 50 in combination with surface parameters, and such surface parameters may include, but are not limited to, pump-related parameters (e.g., pump rate and circulating pressures of the pump unit 64). In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from the coiled tubing unit 60 (e.g., surface weight of the string of coiled tubing 20, speed of the coiled tubing 20, rate of penetration, and other desired parameters). In certain embodiments, the surface data that may be processed by the surface processing system 50 to optimize performance also may include previously recorded data such as fracturing data (e.g., close-in pressures from each fracturing stage, proppant data, friction data, fluid volume data, and other desired data).

In certain embodiments, depending on the type of downhole operation, the downhole data and surface data may be combined and processed by the surface processing system 50 to prevent stalls and to facilitate stall recovery with respect to the downhole well tool 42. In addition, in certain embodiments, processing of the downhole and surface data by the surface processing system 50 may also facilitate cooperative operation of the coiled tubing unit 60, the pump unit 64, the flowback equipment 66, and so forth. This cooperation provides synergy that facilitates output of advisory information and/or automation of the downhole process (e.g., milling process), as well as appropriate adjustment of the rate of penetration (ROP) and pump rates for each individual stage of the operation, by the surface processing system 50. In a milling operation, for example, the individual stages may correspond with milling of each individual plug 30 based on the surface data and downhole data obtained in real-time. It should be noted that the data (e.g., downhole data and surface data) also may be used by the surface processing system 50 to provide advisory information and/or automation of surface processes, such as pumping processes performed by the coiled tubing unit 60, the pump unit 64, the flowback equipment 66, and so forth.

In certain embodiments, use of this data enables the surface processing system 50 to self-learn to provide, for example, optimum downhole WOB and torque for milling each subsequent plug 30 in an efficient manner. This real-time modeling by the surface processing system 50, based on the downhole and surface parameters, enables improved prediction of WOB, torque, and pressure differentials for each plug 30 after the plug 30 that was most recently milled. Such modeling by the surface processing system 50 also enables the milling process (or other downhole process) to be automated and automatically optimized by the surface processing system 50. The downhole parameters also may be used by the surface processing system 50 to predict wear on the downhole motor 34 and/or milling tool 36, and to advise as to timing of the next trip to the surface for replacement of the downhole motor 34 and/or milling tool 36.

The downhole parameters (as well as the a priori data described herein, in certain embodiments) also enable use of pressures below each milled plug 30 to be used by the surface processing system 50 in characterizing the reservoir 16. Such real-time downhole parameters also enable use of pressures below each milled plug 30 by the surface processing system 50 for in situ evaluation and advisory of post-fracturing flow back parameters, and for creating an optimum flow back schedule for maximized production of, for example, hydrocarbon fluids from the surrounding reservoir 16. The data available from a given well may be utilized in designing the next fracturing schedule for the same pad/neighbor wells as well as for plug milling predictions regarding subsequent wells.

During coiled tubing plug mill outs, for example, downhole data such as WOB, torque data from a load module associated with the downhole well tool 42, and bottom hole pressures (internal and external to the bottom hole assembly 32/downhole well tool 42) may be processed via the surface processing system 50. This processed data may then be employed by the surface processing system 50 to control the injector head 62 to generate, for example, a faster and more controlled ROP with respect to milling plugs 30 and/or other obstructions. Additionally, the data may be updated by the surface processing system 50 as the downhole well tool 42 is moved to different positions along the wellbore 14 to help optimize milling throughout stages of the operation. The data also enables automation of the milling process (or other process) through automated controls over the injector head 62 via control instructions provided by the surface processing system 50.

In certain embodiments, data from downhole may be combined by the surface processing system 50 with surface data received from injector head 62 and/or other measured or stored surface data. By way of example, surface data may include hanging weight of the string of coiled tubing 20, speed of the coiled tubing 20, wellhead pressure, choke and flow back pressures, return pump rates, circulating pressures (e.g., circulating pressures from the manifold of a coiled tubing reel in the coiled tubing unit 60), and pump rates. The surface data may be combined with the downhole data by the surface processing system 50 with in real time to provide an automated system that self-controls the injector head 62. For example, the injector head 62 may be automatically controlled (e.g., without human intervention) to optimize ROP as each plug 30 is milled automatically under direction from the surface processing system 50.

Accomplishing automated control over the milling process involves controlling the WOB by the ROP and predicting the WOB for subsequent plugs 30 to enable determination of an optimal ROP (and WOB) for application at each plug 30. In this example, real-time tubing force simulations may be run by the surface processing system 50 using data obtained during milling of the first plug 30. This data serves as a basis to help understand how the next plug milling will behave. The data also helps the surface processing system 50 predict the optimal WOB to maintain an optimum performance of downhole motor 34 by keeping parameters such as RPMs and force relatively stable. This also helps ensure the downhole motor 34 does not stall while optimizing (e.g., maximizing) the rapid milling of each plug 30.

In certain embodiments, data from drilling parameters (e.g., surveys and pressures) as well as fracturing parameters (e.g., volumes and pressures) may be combined with real-time data obtained from sensors 48, 54 during plug milling. The combined data may be used by the surface processing system 50 in a manner that aids in machine learning (e.g., artificial intelligence) to automate subsequent plug milling jobs in the same well and/or for neighboring wells. The accurate combination of data and the updating of that data in real time helps the surface processing system 50 improve the automatic milling of subsequent plugs 30 or performance of other subsequent tasks.

In certain embodiments, depending on the type of operation downhole, the surface processing system 50 may be programmed with a variety of algorithms and/or modeling techniques to achieve desired results. For example, the downhole data and surface data may be combined and at least some of the data may be updated in real time by the surface processing system 50. This updated data may be processed by the surface processing system 50 via suitable algorithms to enable automation and to improve the performance of, for example, downhole well tool 42. By way of example, the data may be processed and used by the surface processing system 50 for preventing motor stalls. In certain embodiments, downhole parameters such as forces, torque, and pressure differentials may be combined by the surface processing system 50 to enable prediction of a next stall of the downhole motor 34 and/or to give a warning to a supervisor. In such embodiments, the surface processing system 50 may be programmed to make self-adjustments (e.g., automatically, without human intervention) to, for example, speed of the injector head 62 and/or pump pressures to prevent the stall, and to ensure efficient continuous milling.

In addition, in certain embodiments, the data and the ongoing collection of data may be used by the surface processing system 50 to monitor various aspects of the performance of downhole motor 34. For example, motor wear may be detected by monitoring the effective torque of the downhole motor 34 based on data obtained regarding pump rates, pressure differentials, and actual torque measurements of the downhole well tool 42. Various algorithms may be used by the surface processing system 50 to help a supervisor on site to predict, for example, how many more hours the downhole motor 34 may be run or how many more plugs 30 may be milled efficiently. This data, and the appropriate processing of the data, may be used by the surface processing system 50 to make automatic decisions or to provide indications to a supervisor as to when to pull the string of coiled tubing 20 to the surface to replace the downhole motor 34, the milling tool 36, or both, while avoiding unnecessary trips to the surface.

In certain embodiments, downhole data and surface data also may be processed via the surface processing system 50 to predict when the string of coiled tubing 20 may become stuck. The ability to predict when the string of coiled tubing 20 may become stuck helps avoid unnecessary short trips and, thus, improves coiled tubing pipe longevity. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 50 to provide predictions as to when the coiled tubing 20 will become stuck.

In certain embodiments, the surface processing system 50 may be designed to provide warnings to a supervisor and/or to self-adjust (e.g., automatically, without human intervention) either the speed of the injector head 62, the pump pressures and rates of the pump unit 64, or a combination of both, so as to prevent the coiled tubing 20 from getting stuck. By way of example, the warnings or other information may be output to a display of the surface processing system 50 to enable an operator to make better, more informed decisions regarding downhole or surface processes related to operation of the downhole well tool 42. In certain embodiments, the speed of the injector head 62 may be controlled via the surface processing system 50 by controlling the slack-off force from the surface. In general, the ability to predict and prevent the coiled tubing 20 from becoming stuck substantially improves the overall milling efficiency, and helps avoid unnecessary short trips if the probability of the coiled tubing 20 getting stuck is minimal. Accordingly, the downhole data and surface data may be used by the surface processing system 50 to provide advisory information and/or automation of surface processes, such as pumping processes or other processes.

When milling each plug 30, trapped pressure is released, which alters the bottom hole pressure (BHP) at that moment. The pressure release may vary both the bottom hole pressure and the equivalent circulating density (ECD), thus altering the BHP dynamics. By monitoring the pressure changes downhole, along with other suitable parameters, the surface processing system 50 may be used to adjust (e.g., self-adjust) the choke/flow back returns via the flowback equipment 66. In general, the adjustments may be performed to maintain near balance conditions (i.e., to keep the downhole parameters within an acceptable range, such as within +/−5%) and to, thus, avoid fluid losses or gains downhole.

In certain embodiments, data from the fracturing stages previously executed in combination with real-time pressure data when each plug 30 is milled, provides a basis for real-time processing/simulations by the surface processing system 50. The real-time processing by the surface processing system 50 enables improved predictions regarding pressure control at the next stage. With accurate modeling/predictions, the flow back and choke control may be substantially improved. The real-time monitoring of downhole parameters such as pressure provides improved and timely feedback, which may be used by the surface processing system 50 to improve control over the downhole operation, and to facilitate automation of that control.

Figure 5:
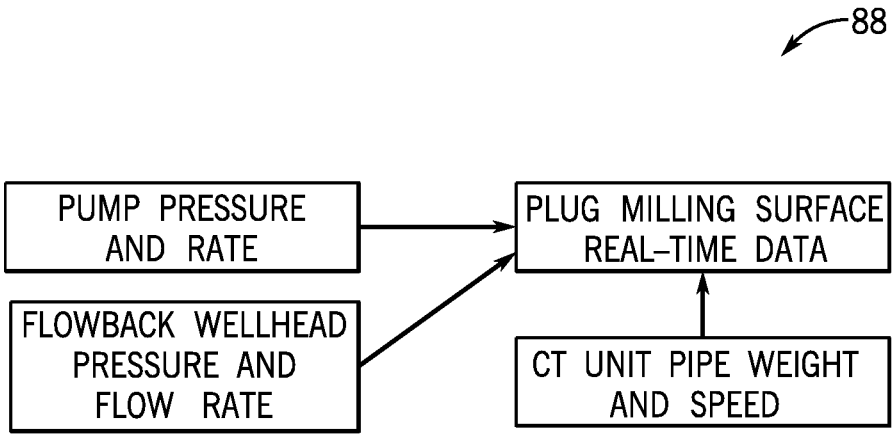
FIG. 5 is a schematic illustration showing various types of data that may be used to optimize performance of a downhole well tool during downhole operations, in accordance with embodiments of the present disclosure.

In certain embodiments, use of surface data and downhole data provided in real time may be used by the surface processing system 50 to facilitate and automate a variety of downhole processes (e.g., plug milling operations) or surface processes, as described in greater detail herein. For example, FIG. 5 illustrates a plug milling operation 88 in which surface data is collected and used by the surface processing system 50 in real time. As illustrated in FIG. 5, the surface processing system 50 may receive pump pressure and pump rate data (e.g., from sensors 54 associated with the pump unit 64) such as pressure and flow rate, flow back and wellhead pressure data (e.g., from sensors 54 associated with the flowback equipment 66 and the injector head 62, respectively), and weight and speed data relating to the coiled tubing (e.g., from sensors 54 associated with the coiled tubing unit 60) in substantially real time, and may use any and all combinations of this data to control a plug milling operation by, for example, sending control signals to control any and all of the operational parameters described herein.

Figure 6:
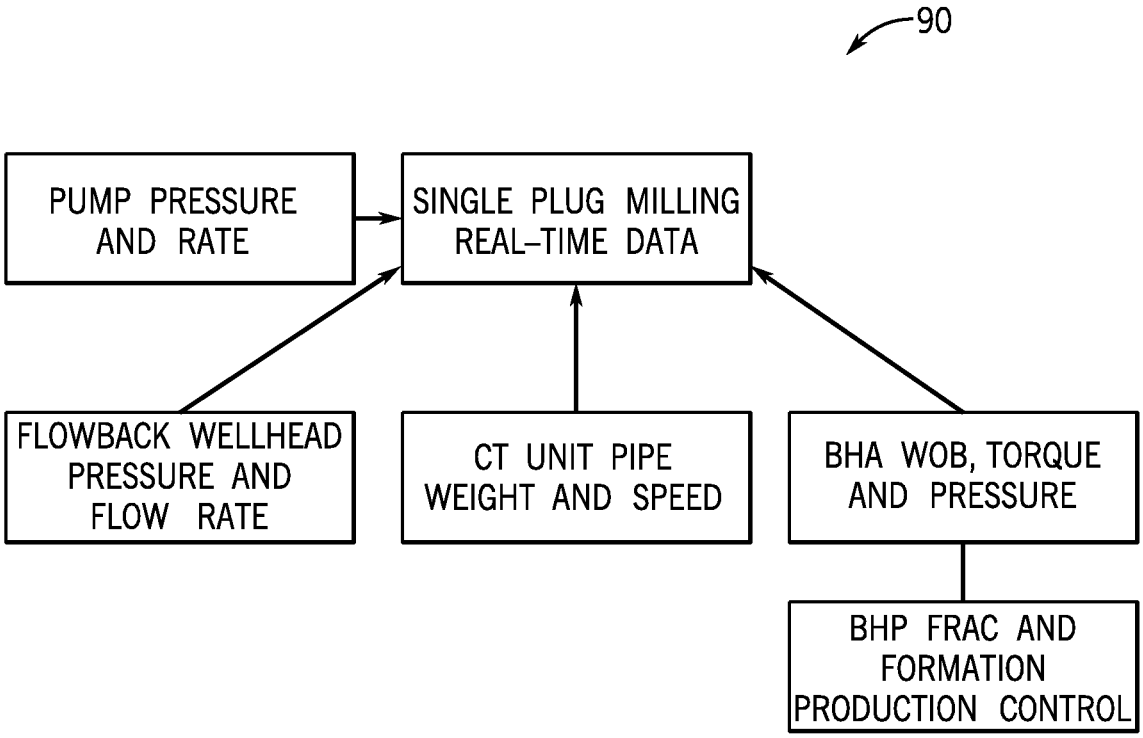
FIG. 6 is a schematic illustration showing various types of data that may be used to optimize performance of a downhole well tool during downhole operations, in accordance with embodiments of the present disclosure.

In certain embodiments, surface data may be combined with additional data obtained from a single plug milling (e.g., from an initial plug milling). For example, FIG. 6 illustrates a plug milling operation 90 in which surface data, along with additional data, is collected and used by the surface processing system 50 in real time. As illustrated in FIG. 6, examples of the additional data include, but are not limited to, downhole data relating to the bottom hole assembly 32, such as WOB, torque, and pressures. Other examples of the additional data include bottom hole pressure data, such as bottom hole pressure data related to fracturing and formation production control. Again, the surface processing system 50 may use any and all combinations of this data to control a plug milling operation by, for example, sending control signals to control any and all of the operational parameters described herein.

Figure 7:
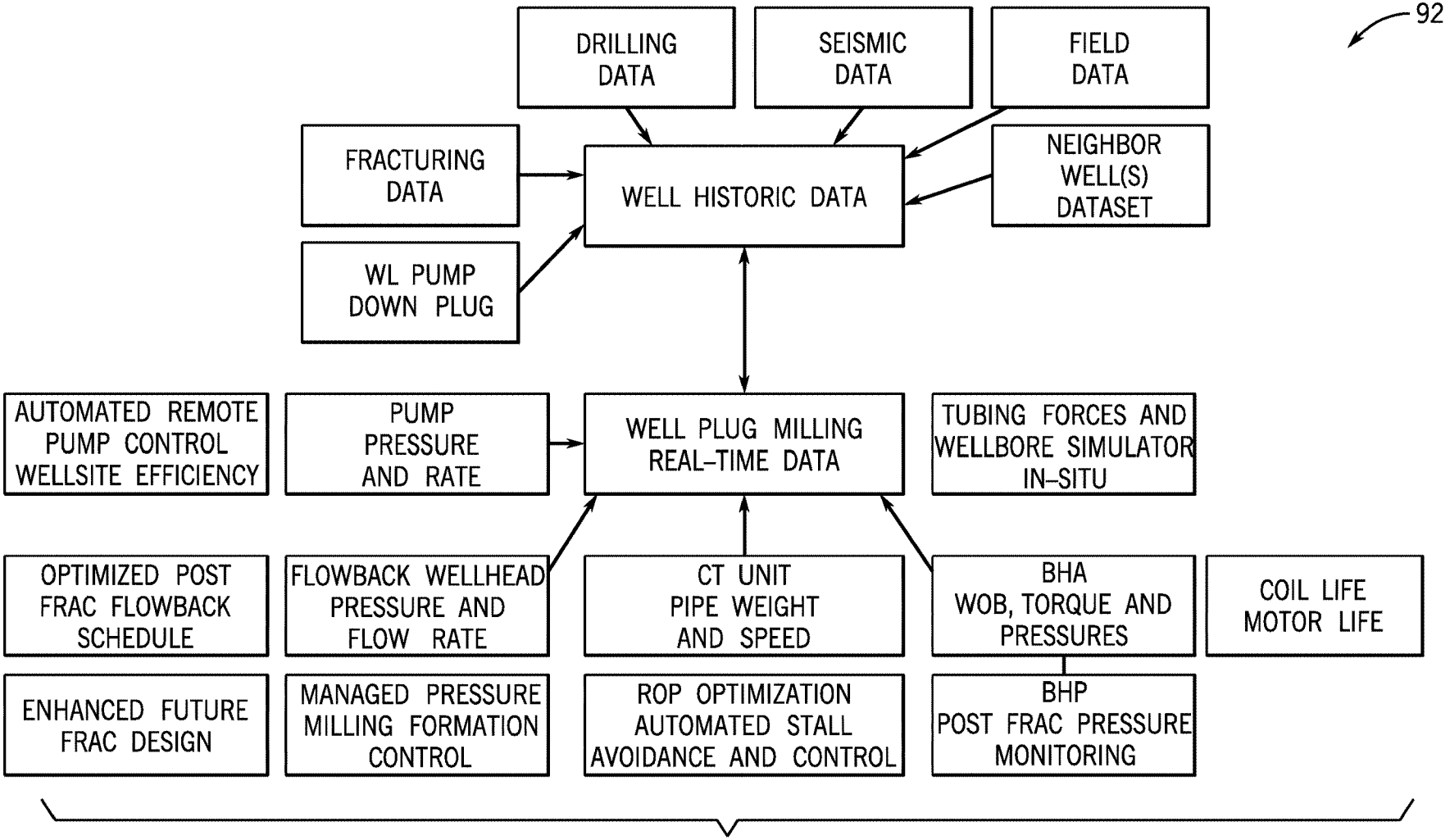
FIG. 7 is a schematic illustration showing various types of data that may be used to optimize performance of a downhole well tool during downhole operations, in accordance with embodiments of the present disclosure.

In addition, in certain embodiments, well historic data also may be used by the surface processing system 50 in, for example, making predictions and providing automated controls. For example, FIG. 7 illustrates a plug milling operation 92 in which surface data, along with additional data and historical data, is collected and used by the surface processing system 50 in real time. As illustrated in FIG. 7, examples of historical well data include historical pump down (e.g., wireline) plug data, historical fracturing data, historical drilling data, historical seismic data, historical field data, and historical data sets from neighboring wells. In certain embodiments, these various types of data may be combined and processed by the surface processing system 50 in via suitable algorithms or techniques to provide various, desired well controls such as automated remote pump control to promote wellsite efficiency.

As also illustrated in FIG. 7, other beneficial types of well control performed by the surface processing system 50 may include automated pump control and wellsite efficiency. In addition, in certain embodiments, the data also may be used by the surface processing system 50 to provide optimized post-fracturing flow back schedules and/or enhanced future fracturing design. In addition, in certain embodiments, the data also may be used by the surface processing system 50 to provide better managed formation control and pressure control to improve milling processes and other processes. For example, in certain embodiments, surface flow rate measurements may be used by the surface processing system 50 to control downhole pressures using the surface equipment described herein. In other words, the data may be used to actively control downhole pressures. In addition, in certain embodiments, the rate of penetration may be optimized by the surface processing system 50 to provide greater efficiency with respect to the overall operation while providing automated stall avoidance and control. In addition, in certain embodiments, various tubing force and wellbore simulations may be performed in situ and in real-time by the surface processing system 50. In addition, in certain embodiments, the data also may be used by the surface processing system 50 to provide life predictions with respect to, for example, predicted remaining life of the downhole motor 34 and/or predicted remaining life of the coiled tubing 20.

The use of real-time data from downhole milling processes (or other downhole or surface processes) and the automation of control by the surface processing system 50 enables a variety of well site improvements. For example, the embodiments described herein may be applied to enable remote operation of the pump unit 64, which allows removal of personnel otherwise present at the wellsite to operate the pump unit 64. In addition, the embodiments described herein provide instrumented flow back via the flowback equipment 66, which may be used, for example, to calculate Reynolds numbers. In addition, in certain embodiments, the wellsite data enables various additional analytics which may be provided to advisors by the surface processing system 50. In addition, in certain embodiments, the data may be used in a variety of ways by the surface processing system 50 including, but not limited to, stall avoidance of the downhole motor 34, reducing wear of the downhole motor 34, increasing life of the coiled tubing 20, avoiding stuck coiled tubing 20, and reducing short trips. The automation provided by the surface processing system 50 described herein also enables a reduction in the number of skilled operators at the wellsite. In addition, in milling applications, the real-time data enables better managed pressure milling, which can reduce formation damage, help characterize post-fracturing formation pressure for flow back, and increase component life by reducing circulation pressures.

FIGS. 8 through 11 illustrate various flow diagrams of processes for controlling the well system 10 described herein using the well control system 68 illustrated in FIG. 4. Specifically, in certain embodiments, the processes illustrated in FIGS. 8 through 11 may be implemented by the surface processing system 50 of the well control system 68 illustrated in FIG. 4 using downhole sensor data received from the downhole sensors 48 described herein, and using surface data received from the surface sensors 54 described herein. As illustrated in FIGS. 8 through 11, in certain embodiments, various operational parameters of the surface equipment 82 (e.g., the coiled tubing unit 60, the pump unit 64, the flowback equipment 66, and so forth) and the downhole equipment 84 (e.g., the BHA 32, the downhole motor 34, the milling tool 36, the downhole well tool 42, and so forth) of the well system 10 may be controlled by the well control system 68 illustrated in FIG. 4 (e.g., via interaction with the actuators 78 and/or the PLCs 80 of the surface equipment 82 and the downhole equipment 84) based at least in part on analysis performed by the one or more analysis modules 70 of the surface processing system 50 using the data received from the downhole sensors 48 and the surface sensors 54.

Figure 8:
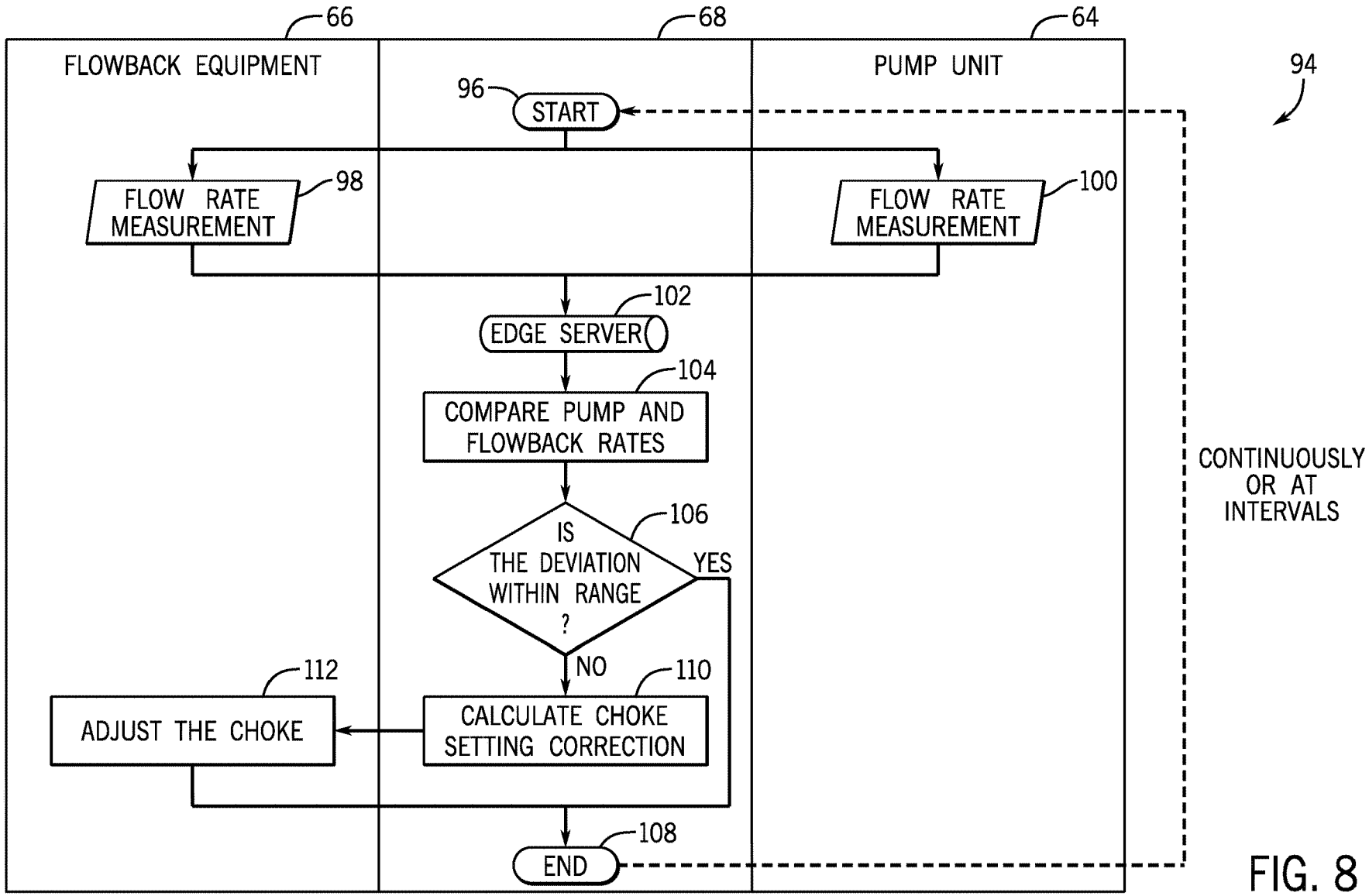
FIG. 8 is a flow diagram of a process for controlling fluid flow rates via choke adjustment, in accordance with embodiments of the present disclosure.

For example, FIG. 8 is a flow diagram of a process 94 for controlling fluid flow rates via choke adjustment. As illustrated in FIG. 8, the process 94 starts at block 96, then the flow rate of the return fluid 40 back through the flowback equipment 66 may be measured via a surface sensor 54 associated with the flowback equipment 66 (block 98), and the flow rate of the fluid 38 pumped into the wellbore 14 from the pump unit 64 may be measured via another surface sensor 54 associated with the pump unit 64 (block 100), in certain embodiments. In certain embodiments, data relating to the flow rate of the return fluid 40 and the flow rate of the fluid 38 pumped into the wellbore 14 may be stored, for example, in an edge server (block 102), which may form part of the well control system 68 illustrated in FIG. 4, or may be part of the cloud storage 58 illustrated in FIG. 4. Then, in certain embodiments, the flow rate of the return fluid 40 and the flow rate of the fluid 38 pumped into the wellbore 14 may be compared (block 104). In certain embodiments, the comparison may be performed by the edge server, or by the edge server in conjunction with the surface processing system 50.

In certain embodiments, a determination of whether the flow rate of the return fluid 40 and the flow rate of the fluid 38 pumped into the wellbore 14 are within a predetermined range (e.g., within 5% of each other, within 2% of each other, within 1% of each other, or even closer) may be made (block 106) based on the comparison of block 104. In certain embodiments, if the deviation between the flow rate of the return fluid 40 and the flow rate of the fluid 38 pumped into the wellbore 14 is within the predetermined range, the process 94 may end at block 108. Alternatively, if the deviation between the flow rate of the return fluid 40 and the flow rate of the fluid 38 pumped into the wellbore 14 is not within the predetermined range, a choke setting correction may be calculated (block 110) to restore a desired balance condition, and a choke setting of the flowback equipment 66 may be automatically adjusted based on the calculated choke setting correction (block 112) before the process 94 ends at block 108. In other embodiments, the calculated choke setting correction may simply be presented to an operator of the well system 10 (e.g., via a display of the surface processing system 50).

As illustrated in FIG. 8, in certain embodiments, the process 94 may be repeated continuously (e.g., the process 94 may start over at block 96 immediately following a previous iteration of the process 94 ends at block 108. Alternatively, as also illustrated in FIG. 8, in other embodiments, the process 94 may be periodically performed at predetermined time intervals. As such, in certain embodiments, the flow rate of the fluid 38 being pumped into the wellbore 14 by the pump unit 64 and the flow rate of the return fluid 40 that flows back up through the wellbore 14 into the flowback equipment 66 may be continuously or periodically optimized, for example, using the process 94 illustrated in FIG. 8.

Surface equipment data integration and automation, which may be attained via use of the process 94 illustrated in FIG. 8, may enable enhanced flow control of mill-out operations. However, surface adjustments made to the surface equipment 82, such as the flowback equipment 66, that react to downhole pressure variations that are experienced when breaking through to expose new perf clusters may be somewhat delayed until the effects are felt at the surface 26. Accordingly, the embodiments described herein also include methods for using downhole data to predict well dynamics behavior, and using this information to adjust pump and choke settings accordingly. As described herein, in certain embodiments, these adjustments may be done using advisors or in an automated fashion.

Another additional benefit of downhole pressure measurements is the ability to assess the quality of the perf cluster that is currently being exposed by the mill-out operations. The mill-out operations provide the first (and likely the last) access to the perf clusters post-fracture, and significant interplay between perf clusters may have changed their behavior since the time of fracturing. As such, the embodiments described herein also include methods for formation characterization using downhole pressure measurements.

Figure 9:
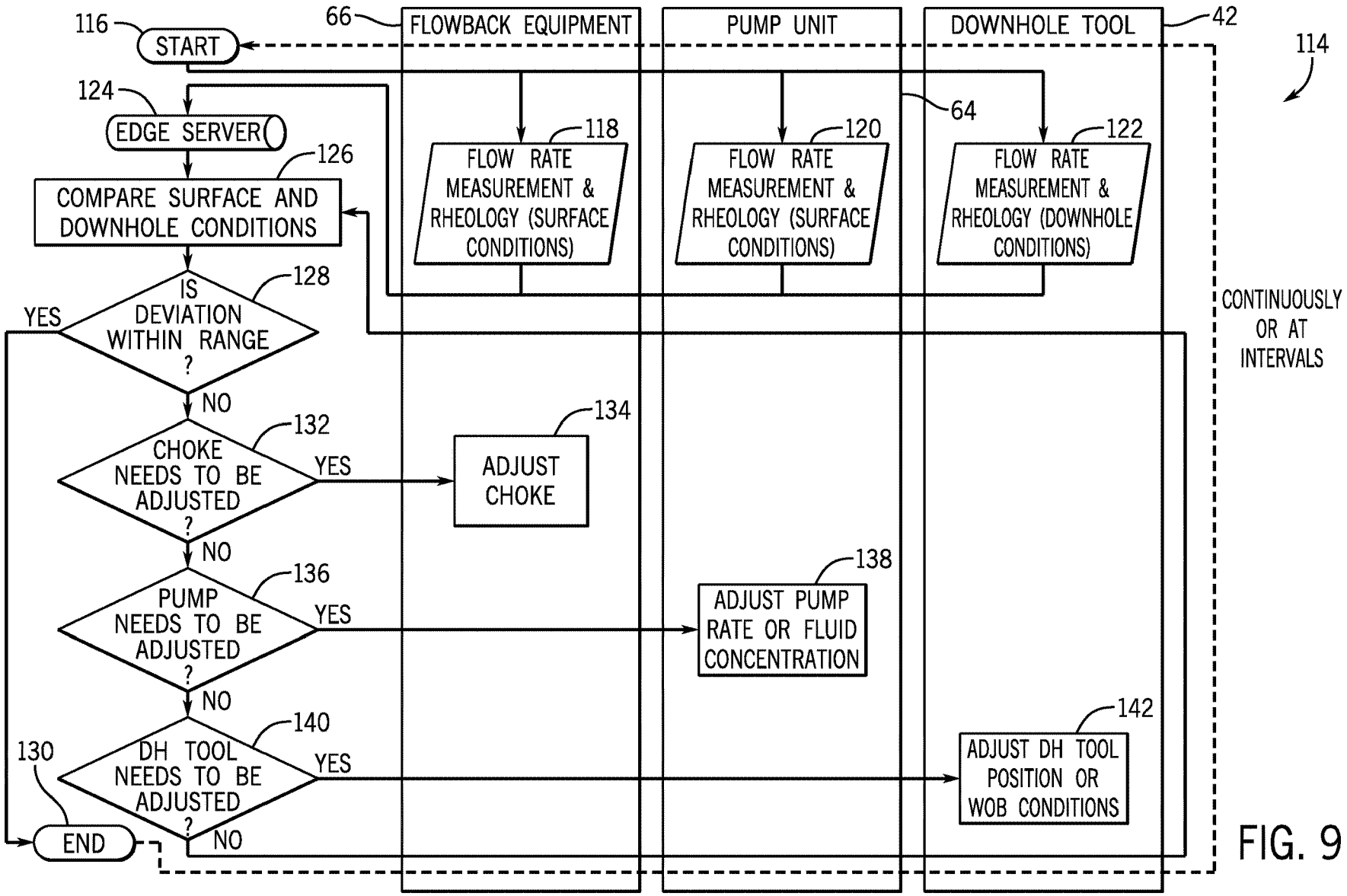
FIG. 9 is a flow diagram of a process for controlling fluid flow rates and rheology via choke, pump, and downhole well tool adjustments, in accordance with embodiments of the present disclosure.

FIG. 9 is a flow diagram of a process 114 for controlling fluid flow rates and rheology via choke, pump, and downhole well tool adjustments. As illustrated in FIG. 9, the process 114 starts at block 116, then the flow rate and the rheology of the return fluid 40 back through the flowback equipment 66 may be measured via one or more surface sensors 54 associated with the flowback equipment 66 (block 118), the flow rate and the rheology of the fluid 38 pumped into the wellbore 14 from the pump unit 64 may be measured via one or more surface sensors 54 associated with the pump unit 64 (block 120), and the flow rate and the rheology of the fluid 38 flowing through the downhole well tool 42 may be measured via one or more downhole sensors 48 associated with the downhole well tool 42 (block 122), in certain embodiments. In certain embodiments, data relating to the flow rate and rheology of the return fluid 40 and the flow rate and rheology of the fluid 38 pumped into the wellbore 14 and flowing through the downhole well tool 42 may be stored, for example, in an edge server (block 124), which may form part of the well control system 68 illustrated in FIG. 4, or may be part of the cloud storage 58 illustrated in FIG. 4. Then, in certain embodiments, the flow rate and the rheology of the return fluid 40 and the flow rate and the rheology of the fluid 38 pumped into the wellbore 14 at the surface 26 may be compared to the flow rate and the rheology of the fluid 38 flowing through the downhole well tool 42 (block 126). In certain embodiments, the comparison may be performed by the edge server, or by the edge server in conjunction with the surface processing system 50.

In certain embodiments, a determination of whether the flow rate and/or the rheology of the return fluid 40 and the flow rate and/or the rheology of the fluid 38 pumped into the wellbore 14 are within predetermined ranges (e.g., within 5% of each other, within 2% of each other, within 1% of each other, or even closer) with respect to the flow rate and/or the rheology of the fluid 38 flowing through the downhole well tool 42 may be made (block 128) based on the comparisons of block 126. In certain embodiments, if the deviations between the flow rate and/or the rheology of the return fluid 40 and the flow rate and/or the rheology of the fluid 38 pumped into the wellbore 14 are within the predetermined ranges with respect to the flow rate and/or the rheology of the fluid 38 flowing through the downhole well tool 42, the process 114 may end at block 130.

Alternatively, if the deviations between the flow rate and/or the rheology of the return fluid 40 and the flow rate and/or the rheology of the fluid 38 pumped into the wellbore 14 are not within the predetermined ranges with respect to the flow rate and/or the rheology of the fluid 38 flowing through the downhole well tool 42, certain adjustments may be made in order to restore a desired balance condition. For example, in certain embodiments, a choke setting correction may be calculated (block 132), and a choke setting of the flowback equipment 66 may be automatically adjusted based on the calculated choke setting correction (block 134) before the process 114 is directed back to block 126. In addition, in certain embodiments, a pump rate and/or fluid concentration setting correction may be calculated (block 136), and a pump rate and/or fluid concentration setting (e.g., an amount and/or type of fluid additives) of the pump unit 64 may be automatically adjusted based on the calculated pump rate and/or fluid concentration setting correction (block 138) before the process 114 is directed back to block 126. In addition, in certain embodiments, a position, torque, and/or WOB setting correction may be calculated (block 140), and a position, torque, and/or WOB setting of the downhole well tool 42 may be automatically adjusted based on the calculated position, torque, and/or WOB setting correction (block 142) before the process 114 is directed back to block 126. In certain embodiments, each of these corrections may be made in the presented order until no further corrections are needed (e.g., when the deviations between the flow rate and/or the rheology of the return fluid 40 and the flow rate and/or the rheology of the fluid 38 pumped into the wellbore 14 are within the predetermined ranges with respect to the flow rate and/or the rheology of the fluid 38 flowing through the downhole well tool 42). As discussed herein, in other embodiments, the calculated setting corrections may simply be presented to an operator of the well system 10 (e.g., via a display of the surface processing system 50).

As illustrated in FIG. 9, in certain embodiments, the process 114 may be repeated continuously (e.g., the process 114 may start over at block 116 immediately following a previous iteration of the process 114 ends at block 130. Alternatively, as also illustrated in FIG. 9, in other embodiments, the process 114 may be periodically performed at predetermined time intervals. By properly adjusting one or multiple of these settings and conditions, the deviated flowback, pumping, downhole tool, and milling operations may be brought back to an optimal state by the surface processing system 50.

Figure 10:
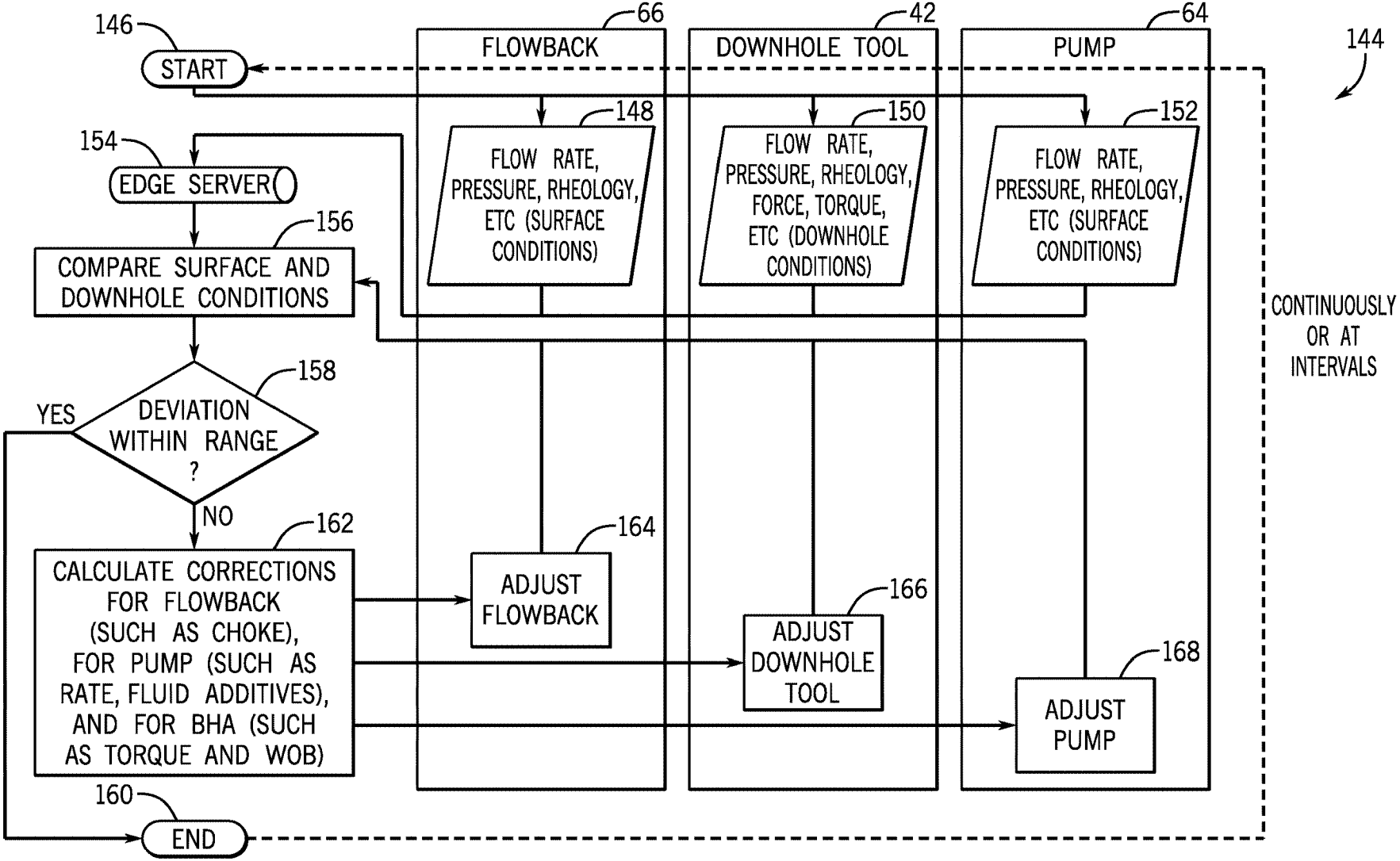
FIG. 10 is a flow diagram of a process for controlling fluid flow rates, pressure, and rheology via choke, pump, and downhole well tool adjustments, in accordance with embodiments of the present disclosure.

FIG. 10 is a flow diagram of a process 144 for controlling fluid flow rates, pressure, and rheology via choke, pump, and downhole well tool adjustments. As illustrated in FIG. 10, the process 144 starts at block 146, then the flow rate, the pressure, and the rheology of the return fluid 40 back through the flowback equipment 66 may be measured via one or more surface sensors 54 associated with the flowback equipment 66 (block 148), the flow rate, the pressure, and the rheology of the fluid 38 flowing through the downhole well tool 42, as well as the forces and torque applied to the downhole well tool 42 (e.g., by the downhole hydraulic motor 34) may be measured via one or more downhole sensors 48 associated with the downhole well tool 42 (block 150), and the flow rate, the pressure, and the rheology of the fluid 38 pumped into the wellbore 14 from the pump unit 64 may be measured via one or more surface sensors 54 associated with the pump unit 64 (block 152), in certain embodiments. In certain embodiments, data relating to the flow rate, pressure, and rheology of the return fluid 40 and the flow rate, pressure, and rheology of the fluid 38 pumped into the wellbore 14 and flowing through the downhole well tool 42 (as well as data relating to the forces and torque applied to the downhole well tool 42) may be stored, for example, in an edge server (block 154), which may form part of the well control system 68 illustrated in FIG. 4, or may be part of the cloud storage 58 illustrated in FIG. 4. Then, in certain embodiments, the flow rate, the pressure, and the rheology of the return fluid 40 and the flow rate, the pressure, and the rheology of the fluid 38 pumped into the wellbore 14 at the surface 26 may be compared to the flow rate, the pressure, and the rheology of the fluid 38 flowing through the downhole well tool 42 (block 156). In certain embodiments, the comparison may be performed by the edge server, or by the edge server in conjunction with the surface processing system 50.

In certain embodiments, a determination of whether the flow rate, the pressure, and/or the rheology of the return fluid 40 and the flow rate, the pressure, and/or the rheology of the fluid 38 pumped into the wellbore 14 are within predetermined ranges (e.g., within 5% of each other, within 2% of each other, within 1% of each other, or even closer) with respect to the flow rate, the pressure, and/or the rheology of the fluid 38 flowing through the downhole well tool 42 may be made (block 158) based on the comparisons of block 156. In certain embodiments, if the deviations between the flow rate, the pressure, and/or the rheology of the return fluid 40 and the flow rate, the pressure, and/or the rheology of the fluid 38 pumped into the wellbore 14 are within the predetermined ranges with respect to the flow rate, the pressure, and/or the rheology of the fluid 38 flowing through the downhole well tool 42, the process 144 may end at block 160.

Alternatively, if the deviations between the flow rate, the pressure, and/or the rheology of the return fluid 40 and the flow rate, the pressure, and/or the rheology of the fluid 38 pumped into the wellbore 14 are not within the predetermined ranges with respect to the flow rate and/or the rheology of the fluid 38 flowing through the downhole well tool 42, certain adjustments may be made in order to restore a desired balance condition. For example, in certain embodiments, a choke setting correction may be calculated (block 162), and a choke setting of the flowback equipment 66 may be automatically adjusted based on the calculated choke setting correction (block 164) before the process 144 is directed back to block 156. In addition, in certain embodiments, a position, torque, and/or WOB setting correction may be calculated (block 162), and a position, torque, and/or WOB setting of the downhole well tool 42 may be automatically adjusted based on the calculated position, torque, and/or WOB setting correction (block 166) before the process 144 is directed back to block 156. In addition, in certain embodiments, a pump rate and/or fluid concentration setting correction may be calculated (block 162), and a pump rate and/or fluid concentration setting (e.g., an amount and/or type of fluid additives) of the pump unit 64 may be automatically adjusted based on the calculated pump rate and/or fluid concentration setting correction (block 168) before the process 144 is directed back to block 156. In certain embodiments, each of these corrections may be based at least in part on the data relating to the forces and torque applied to the downhole well tool 42. In addition, in certain embodiments, each (or, at least some) of these corrections may be made in the presented order, or in a different order, or simultaneously, until no further corrections are needed (e.g., when the deviations between the flow rate, the pressure, and/or the rheology of the return fluid 40 and the flow rate, the pressure, and/or the rheology of the fluid 38 pumped into the wellbore 14 are within the predetermined ranges with respect to the flow rate and/or the rheology of the fluid 38 flowing through the downhole well tool 42). As discussed herein, in other embodiments, the calculated setting corrections may simply be presented to an operator of the well system 10 (e.g., via a display of the surface processing system 50).

As illustrated in FIG. 10, in certain embodiments, the process 144 may be repeated continuously (e.g., the process 144 may start over at block 146 immediately following a previous iteration of the process 144 ends at block 160. Alternatively, as also illustrated in FIG. 10, in other embodiments, the process 144 may be periodically performed at predetermined time intervals. By properly adjusting one or multiple of these settings and conditions, the deviated flowback, pumping, downhole tool, and milling operations may be brought back to an optimal state by the surface processing system 50.

In other embodiments, the downhole measurements described herein may be collected, and used to identify and analyze signals p of interest from the downhole measurements to, for example, indicate certain types of new formation zones that are encountered as the downhole well tool 42 traverses downhole through the wellbore 14. When the surface processing system 50 identifies signals p of interest that indicate certain types of new formation zones that are encountered by the downhole well tool 42, the surface processing system 50 may automatically adjust certain operational parameters of the well system 10 (e.g., flow rates and pressures of the fluids 38, 40 described herein) to account for the new formation zones. Such methods enable pressure and flow management that operates in a more informed manner, rather than in an ad-hoc fashion.

Figure 11:
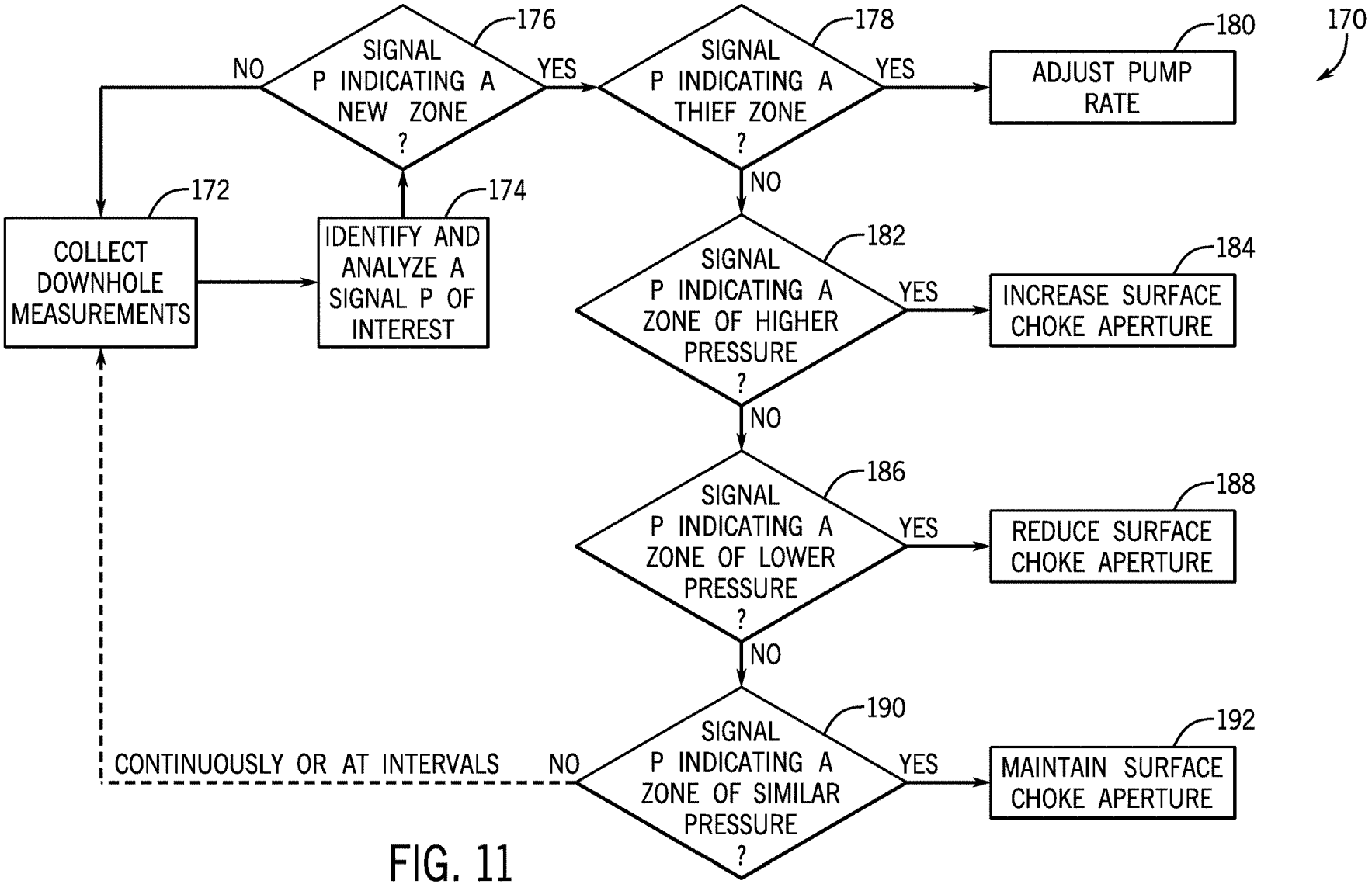
FIG. 11 is a flow diagram of a process for controlling fluid flow rates and pressures based on identification and analysis of signals p of interest in downhole measurements, in accordance with embodiments of the present disclosure.

For example, FIG. 11 is a flow diagram of a process 170 for controlling fluid flow rates and pressures based on identification and analysis of signals p of interest in downhole measurements collected from downhole sensors 48 as described herein. The process begins with the collection of downhole measurements via the downhole sensors 48 described herein (block 172). In certain embodiments, the downhole measurements may include the measurement of any and all of the downhole parameters described herein including, but not limited to, the flow rate, the pressure, and the rheology of the fluid 38 flowing through the downhole well tool 42, as well as the forces and torque applied to the downhole well tool 42 (e.g., by the downhole hydraulic motor 34). Then, signals p of interest may be identified and analyzed (block 174), and determinations may be made about whether the signals p of interest indicate that a new formation zone is being encountered by the downhole well tool 42 as the downhole well tool is traversing downhole through the wellbore 14. If a signal p of interest indicates that a new formation zone is not currently being encountered by the downhole well tool 42 (block 176), the process 170 may proceed back to block 172.

However, if a signal p of interest indicates that a new formation zone is being encountered by the downhole well tool 42 (block 176), the process 170 may determine if automatic adjustments to certain operational parameters of the well system 10 should be made. For example, if a signal p of interest indicates that a new formation zone is a thief zone (block 178), then a pump rate of the pump unit 64 may be automatically adjusted in response to this determination (block 180) to minimize fluid losses while maintain circulation rates to ensure efficient cleaning. However, it should be noted that, in certain embodiments, if a signal p of interest indicates that a new formation zone is a thief zone (block 178), another course of action may be to automatically reduce a choke aperture of a choke of the flowback equipment 66. In addition, if a signal p of interest indicates that a new formation zone has a higher pressure than a previously-encountered formation zone (block 182), then a choke aperture of a choke of the flowback equipment 66 may be automatically increased in response to this determination (block 184). Conversely, if a signal p of interest indicates that a new formation zone has a lower pressure than a previously-encountered formation zone (block 186), then a choke aperture of a choke of the flowback equipment 66 may be automatically reduced in response to this determination (block 188). Furthermore, if a signal p of interest indicates that a new formation zone has a substantially similar pressure (e.g., within 5% of each other, within 2% of each other, within 1% of each other, or even closer) to that of a previously-encountered formation zone (block 190), then a choke aperture of a choke of the flowback equipment 66 may be maintained (i.e., not adjusted) in response to this determination (block 192).

As illustrated in FIG. 11, in certain embodiments, the process 170 may be repeated continuously (e.g., the process 170 may start over at block 172 immediately following a previous iteration of the process 170 ends. Alternatively, as also illustrated in FIG. 11, in other embodiments, the process 170 may be periodically performed at predetermined time intervals. By properly adjusting one or multiple of these settings and conditions, the new formation zones that are encountered by the downhole well tool 42 may be automatically accounted for by the surface processing system 50.

Each of the processes 94, 114, 144, 170 may be performed by the surface processing system 50 individually, or may be performed by the surface processing system 50 in conjunction with each other. For example, in certain embodiments, any and all of the surface parameters and/or the downhole parameters described herein may be used as inputs by the surface processing system 50 to determine appropriate output control signals to control any and all of the operational parameters described herein. In other words, the individual processes 94, 114, 144, 170 described herein are merely exemplary, and not intended to be limiting. In general, each of these processes 94, 114, 144, 170 facilitates faster and more accurate responses to changes that occur downhole while the downhole well tool 42 traverses the wellbore 14 during, for example, mill-out operations of plugs 30.

The embodiments described herein may be used to optimize (e.g., maximize) a rate of penetration for milling out plugs 30 disposed along a wellbore 14 using the well control system 68 illustrated in FIG. 4. For example, in certain embodiments, the well control system 68 may be used to maximize a rate of penetration for milling out plugs 30 along a wellbore 14 after hydraulic fracturing operations.

As explained in greater detail herein, in certain embodiments, a downhole well tool 42 (e.g., a milling tool) may be coupled with coiled tubing 20 to form a coiled tubing string. In addition, in certain embodiments, downhole sensors 48 may be positioned along the string of coiled tubing 20 to obtain sensor data when the downhole well tool 42 is moved along the wellbore 14. In certain embodiments, the sensor data from the downhole sensors 48 may then be used by the surface processing system 50 to determine a coefficient of friction (COF) value based on friction acting on the string of coiled tubing 20. In certain embodiments, as the downhole well tool 42 is moved to different positions along the wellbore 14, the COF value may be updated by the surface processing system 50 (e.g., based on the changing sensor data from the downhole sensors 48) to obtain updated COF values. In certain embodiments, the updated COF values may then be employed by the surface processing system 50 to adjust a tubing weight acting on the downhole well tool 42 to achieve a desired rate of penetration (ROP). In certain embodiments, the sensor data from the downhole sensors 48 may be provided to the surface processing system 50 in real-time to enable real-time updating of the COF value. Additionally, in certain embodiments, the sensor data obtained by the downhole sensors 48 during actual operation may be combined with surface data (e.g., monitored data and/or historical data) and/or other types of data to facilitate accurate modeling of the optimal (e.g., maximum) ROP.

In certain embodiments, the efficiency of a given operation (e.g., a milling operation) may be optimized by the surface processing system 50 by determining a desired ROP. For example, in certain embodiments, the weight of the coiled tubing 20 may be adjusted to achieve the desired ROP (e.g., to maintain the desired ROP within a predetermined threshold, such as +/−10% of the desired ROP, +/−5% of the desired ROP, +/−3% of the desired ROP, +/−1% of the desired ROP, or even closer) based at least in part on a coefficient of friction (COF), which is based on friction acting on the string of coiled tubing 20 (e.g., friction between the coiled tubing 20 and a surrounding wall of the wellbore 14), as described in greater detail herein. In general, more accurate knowledge with respect to the COF enables a more efficient ROP and, thus, a more efficient overall operation.

In an operational example, the ROP may be maximized. In certain embodiments, this maximization of the ROP may be achieved by the surface processing system 50 by leveraging edge data and cloud data computations, by integrating downhole and surface measurement data with historical well and treatment data, and by calculating tubing string force in real-time through parametric calibration without compromising downhole equipment and surface equipment integrity. Such data may be processed via the surface processing system 50 to improve the accuracy and consistency of tubing force prediction for achieving desired results.

For example, optimal WOB predictions and implementations may be used by the surface processing system 50 in achieving the maximum ROP possible, for example, based on other operational parameters. In certain embodiments, the well control system 68 may control WOB instead of ROP in order to maximize ROP. In other words, a more accurate and consistent tubing force prediction generally leads to a more accurate and consistent WOB prediction and application during a given operation. Due to reduced uncertainty in tubing force and WOB prediction, a faster ROP may be achieved with higher confidence and lower risk. In certain embodiments, various types of software modules may be used by the surface processing system 50 to predict the weight of the coiled tubing at the surface as a function of depth of the coiled tubing 20. Such software modules may be referred to as tubing force modules (TFM).

In general, monitoring and controlling WOB in substantially real time may lead to enhanced optimization of ROP. For example, the ability to quickly and accurately detect significant changes in WOB may lead to enhanced optimization of ROP. In certain embodiments, WOB may be obtained via direct downhole measurements, for example, via downhole sensors 48. For example, for direct downhole load cell measurements, the change in WOB may be calculated (e.g., by the surface processing system 50) as:

$$\Delta W_{ob} = W_{ob2} - W_{ob1} \tag{1}$$

where ΔWob is the change in WOB, $Wob_2$ is the measured WOB at time moment $t_2$, and $Wob_1$ is the measured WOB at time moment $t_1$.

However, as described in greater detail herein, WOB may be obtained via indirect surface measurements, for example, via surface sensors 54. For example, for indirect surface load cell measurements, the determination of a change in WOB is relatively more complex. As illustrated in FIGS. 1-3, for a typical run in hole (RIH) operation, the force balance yields the following:

$$m_r=(W_p-F_{sn})-(F_d+F_s)-W_{ob} \quad (2)$$

where $M_r$ is the surface load measurement (e.g., via a load cell or load pin in certain embodiments), $W_p$ is the weight of the buoyed pipe (i.e., coiled tubing 20) and the BHA 32, $F_{sn}$ is the snubbing force, $F_d$ is the pipe-on-wall drag force due to friction, $F_s$ is the stripper-induced friction, and $W_{ob}$ is the downhole WOB. Of these elements, $F_{sn}$ (the snubbing force) and $F_s$ (the stripper friction) are usually relatively constant (e.g., vary less than 1% or even less) within a relatively short distance of BHA travel. Thus, the change in WOB, within a relatively short distance of BHA travel, may be calculated as in Equation (3):

$$\Delta W_{ob}=W_{ob2}-W_{ob1}=(W_{p2}-F_{d2}-M_{r2})-W_{p1}-F_{d1}-M_{r1}) \quad (3)$$

where in Equation (3), the subscript 2 indicates time moment $t_2$, and the subscript 1 indicates time moment $t_1$. Equation (3) shows that the change in WOB may be calculated by the surface processing system 50 based on the surface load measurements, in conjunction with the weight of the buoyed pipe (i.e., coiled tubing 20) and the BHA 32 and the pipe-on-wall drag force due to friction calculations. As such, as described in greater detail herein, the COF, which is based on friction acting on the string of coiled tubing 20 (e.g., friction between the coiled tubing 20 and a surrounding wall of the wellbore 14), is a relatively important value to be determined by the surface processing system 50 in order to indirectly determine WOB based on surface measurements collected by surface sensors 54, for example.

It may be assumed that correlations exist between surface and downhole measurements with respect to WOB. In general, the surface measurements usually tend to lag behind the downhole measurements and tend to have a lower amplitude. With this in mind, in certain embodiments, the surface processing system 50 may calibrate the indirect surface WOB measurements (e.g., Equation (3)) with the direct downhole WOB measurements (e.g., Equation (1)) to enhance the ability of WOB control by the surface processing system 50. This enables more accurate and consistent WOB control, for example, when downhole measurements are not available.

In certain embodiments, an empirically determined COF between the string of coiled tubing 20 and the surrounding well surface (e.g., of the wellbore 14) may be used by the surface processing system 50 to predict the weight of the coiled tubing 20 at the surface to achieve a desired ROP. For example, in certain embodiments, the determined COF between the string of coiled tubing and the surrounding wellbore 14 may be used by the surface processing system 50 to determine the pipe-on-wall drag force due to friction (Fa) described herein. However, the COF changes as the downhole well tool 42 is moved to different depths in the wellbore 14. As described in greater detail herein, in certain embodiments, the data obtained from the downhole sensor package 46 and the downhole sensors 48 may be combined with surface data from surface sensors 54 and/or historical data by the surface processing system 50 to continually update the COF value at different depths or stages of a given well operation.

In certain embodiments, the surface processing system 50 may dynamically calibrate the COF in real time during a given job to provide continually updated COF values. Referring to FIG. 1, the downhole well tool 42 may be moved down through a long horizontal section of wellbore 14 to sequentially mill out a plurality of plugs 30. In this example, the COF value may be updated by the surface processing system 50 at several positions along the entire wellbore 14 as the downhole well tool 42 is run in hole. In such an embodiment, the COF may be updated by the surface processing system 50 at N different positions along the wellbore 14 as the downhole well tool 42 and the coiled tubing 20 are running in hole. In certain embodiments, the COF may be updated by the surface processing system 50 to periodically (e.g., updated at a given time interval). In certain embodiments, the distance along the wellbore 14 between the N different positions may be adjusted by the surface processing system 50 as desired to achieve a successful operation. For example, the distance between positions at which the COF is updated by the surface processing system 50 may be at most 500 feet, at most 50 feet, at most 5 feet, or at other suitable distances depending on well conditions and operational parameters.

Similarly, in certain embodiments, the COF value may be updated by the surface processing system 50 at N different depths or positions along the wellbore 14 during operations in which the downhole well tool 42 is pulled out of hole. Once again, the distance between positions at which the COF may be updated by the surface processing system 50 may be at most 500 feet, at most 50 feet, at most 5 feet, or at other suitable distances depending on well conditions and operational parameters of the pulling out of hole operation. It should be noted that, in certain embodiments, the distances between COF updates may vary, whereas the COF value may be updated substantially continuously (e.g., in substantially real time) in other embodiments.

Figure 12:
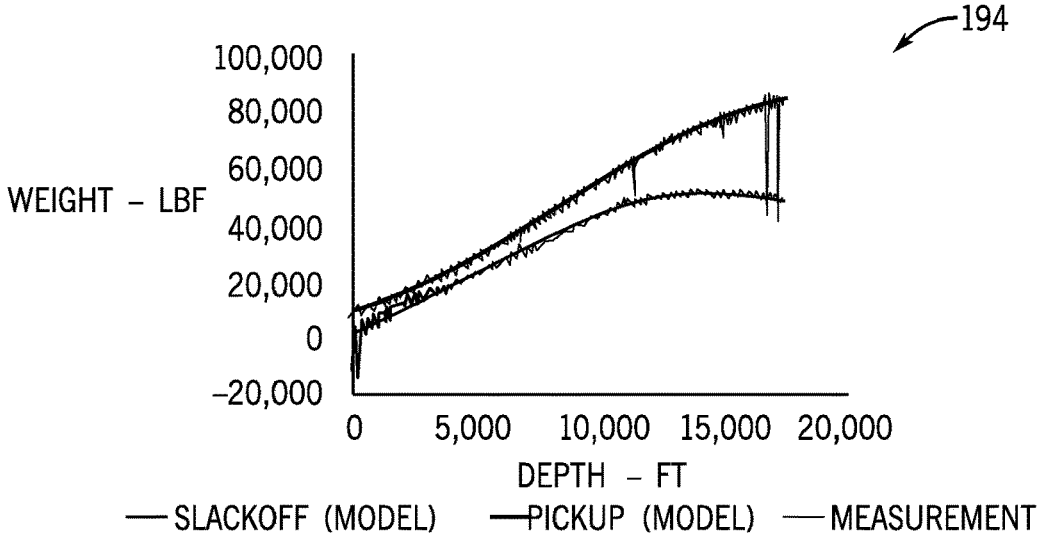
FIG. 12 is a graphical representation illustrating model versus measured coiled tubing weight, in accordance with embodiments of the present disclosure.

By utilizing the appropriate downhole data and surface data (e.g., edge data and storage/cloud data), the changing COF value resulting from changes in well conditions and operational conditions may be determined by the surface processing system 50 so as to improve the WOB/tubing string weight determination. This, in turn, enables improved accuracy and maximization of the ROP, thereby resulting in a more efficient overall milling operation or other downhole operation. As illustrated in the graph 194 in FIG. 12, use of downhole data and surface data enables a strong correlation between the modeled weight of the coiled tubing 20 and the measured weight of the coiled tubing 20 for achieving a maximized ROP. As such, monitoring and use of this data substantially improves the accuracy and consistency of weight prediction for achieving the desired ROP.

Figure 13:
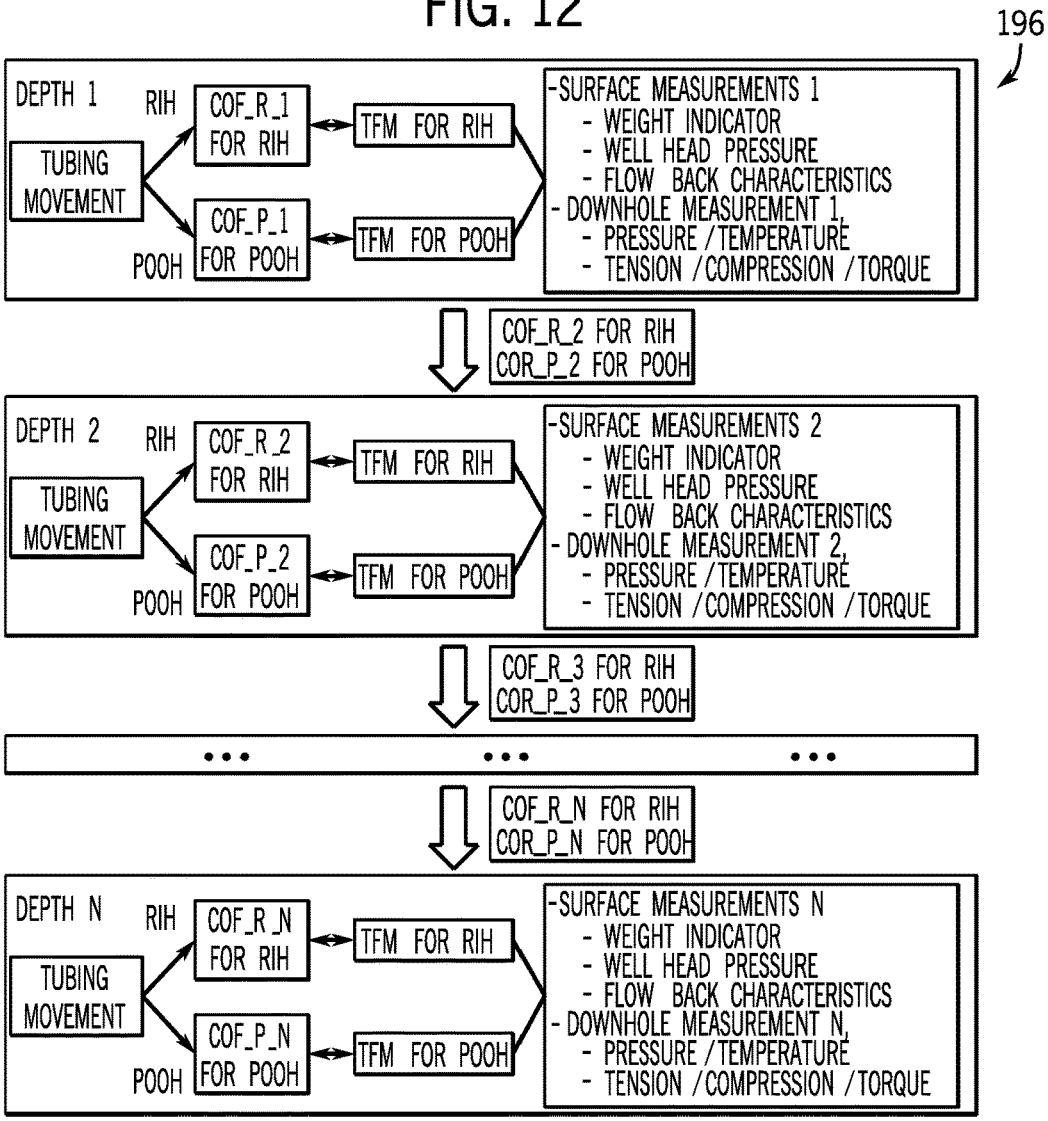
FIG. 13 is a graphical illustration of an example of data used in a model for determining coefficient of friction and corresponding coiled tubing string movement, in accordance with embodiments of the present disclosure.

Referring generally to FIG. 13, an example workflow 196 at each depth for achieving a desired ROP/tubing movement is provided. In the illustrated example, surface measurements and downhole measurements may be provided to a tubing force module (TFM) or other suitable software of the surface processing system 50 to determine the corresponding COF at that particular depth or position along the wellbore 14. As illustrated, calculation of the COF values may differ depending on whether the downhole well tool 42 is being run in hole (RIH) or pulled out of hole (POOH). As described in greater detail herein, in certain embodiments, for each update of the COF values, the TFM module may be updated.

The COF may then be used by the surface processing system 50 to determine the appropriate WOB to achieve the desired tubing movement/ROP for efficient milling of plugs 30 (or other downhole operation). In certain embodiments, the various measurements may be provided in real time to ensure rapid and accurate modeling of the data by the surface processing system 50 as the downhole well tool 42 is moved to different positions along the wellbore 14. In certain embodiments, well site measurements from both the surface and downhole may be utilized by the surface processing system 50 to continuously update model parameters and, thus, to enable a more accurate and consistent modeling with respect to predicting the appropriate WOB/tubing weight and, thus, the maximum or otherwise optimized ROP.

As illustrated in FIG. 13, in certain embodiments, examples of surface measurements obtained via surface sensors 54 include weight indications (e.g., tubing string weight indications, wellhead pressure, and flow back characteristics), and examples of downhole measurements obtained via the downhole sensor package 46 and downhole sensors 48 include pressure measurements, temperature measurements, tension and compression measurements (e.g., tension and compression in the coiled tubing 20), and torque acting on the downhole well tool 42, as described in greater detail herein.

Figure 14:
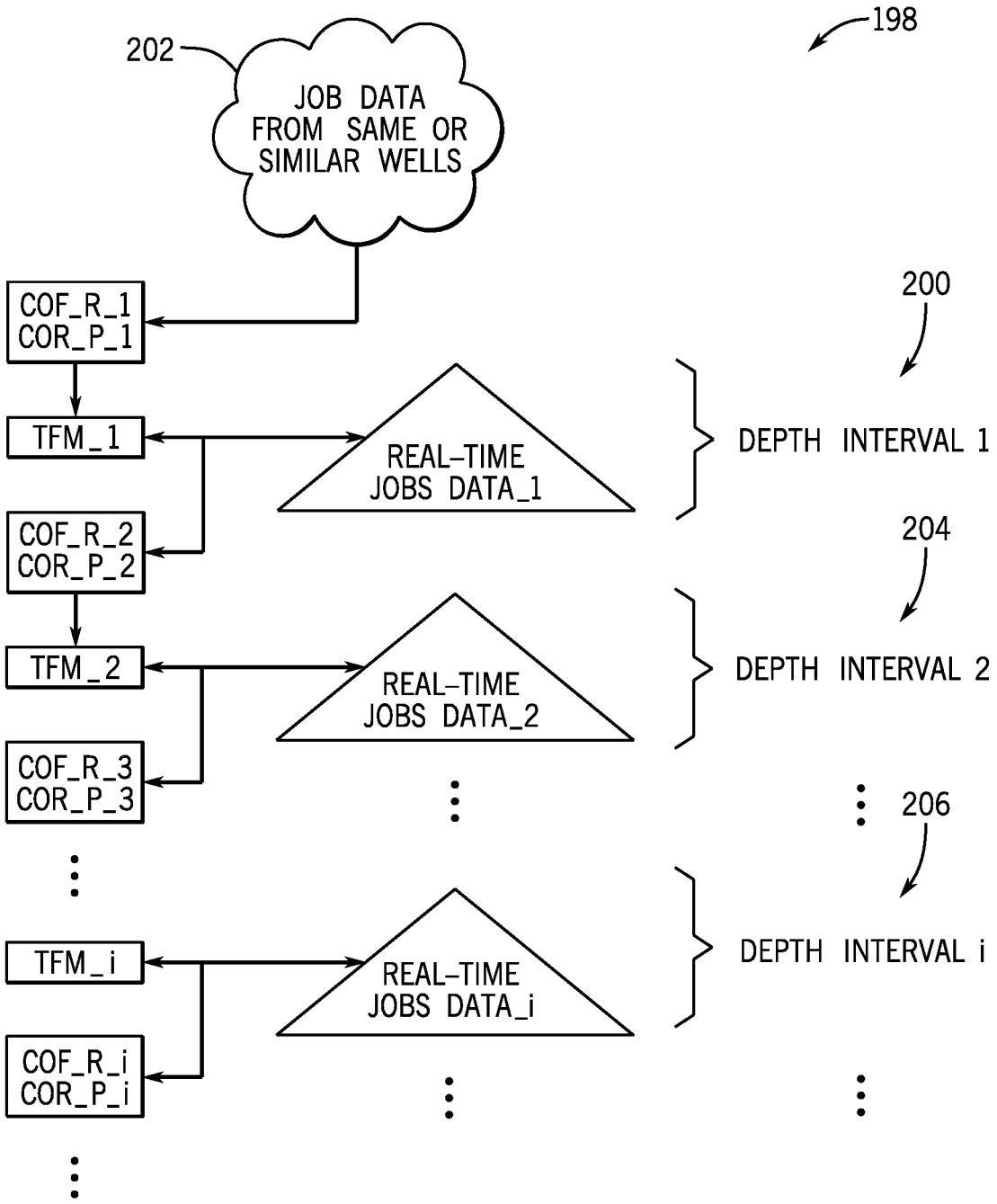
FIG. 14 is a graphical illustration showing real-time updating of coefficient of friction values to obtain the updated coefficient of friction values for use in determining an appropriate tubing weight for a desired rate of penetration, in accordance with embodiments of the present disclosure.

Referring generally to FIG. 14, a more detailed example of a workflow 198 for the real time updating of the COF values is illustrated. For the first depth interval 200 and the initial TFM model in this example, the COF value may be obtained from memory 202 (e.g., from the cloud storage 58 illustrated in FIG. 4) based on job data previously recorded from a similar well (or even the same well). For the second depth interval 204, the COF value may be updated on the edge (e.g., using an edge server, as described herein) based at least in part on real-time data obtained at least in part from downhole sensor package 46 and the downhole sensors 48.

Subsequently, for the third depth interval 206, the COF value may again be updated on the edge (e.g., using an edge server, as described herein) based at least in part on real-time data obtained at least in part from downhole sensor package 46 and the downhole sensors 48. Such updating may be continued during the job at each depth/borehole position. The interval between positions may be set by the surface processing system 50 at a desired value (e.g., every 500 feet, every 50 feet, every 5 feet, and so forth) depending on the parameters of a given operation and on various other factors such as computational resources. As described in greater detail herein, the surface processing system 50 may be in the form of a single component or multiple components located at the surface, downhole, and/or remote locations.

Figure 15:
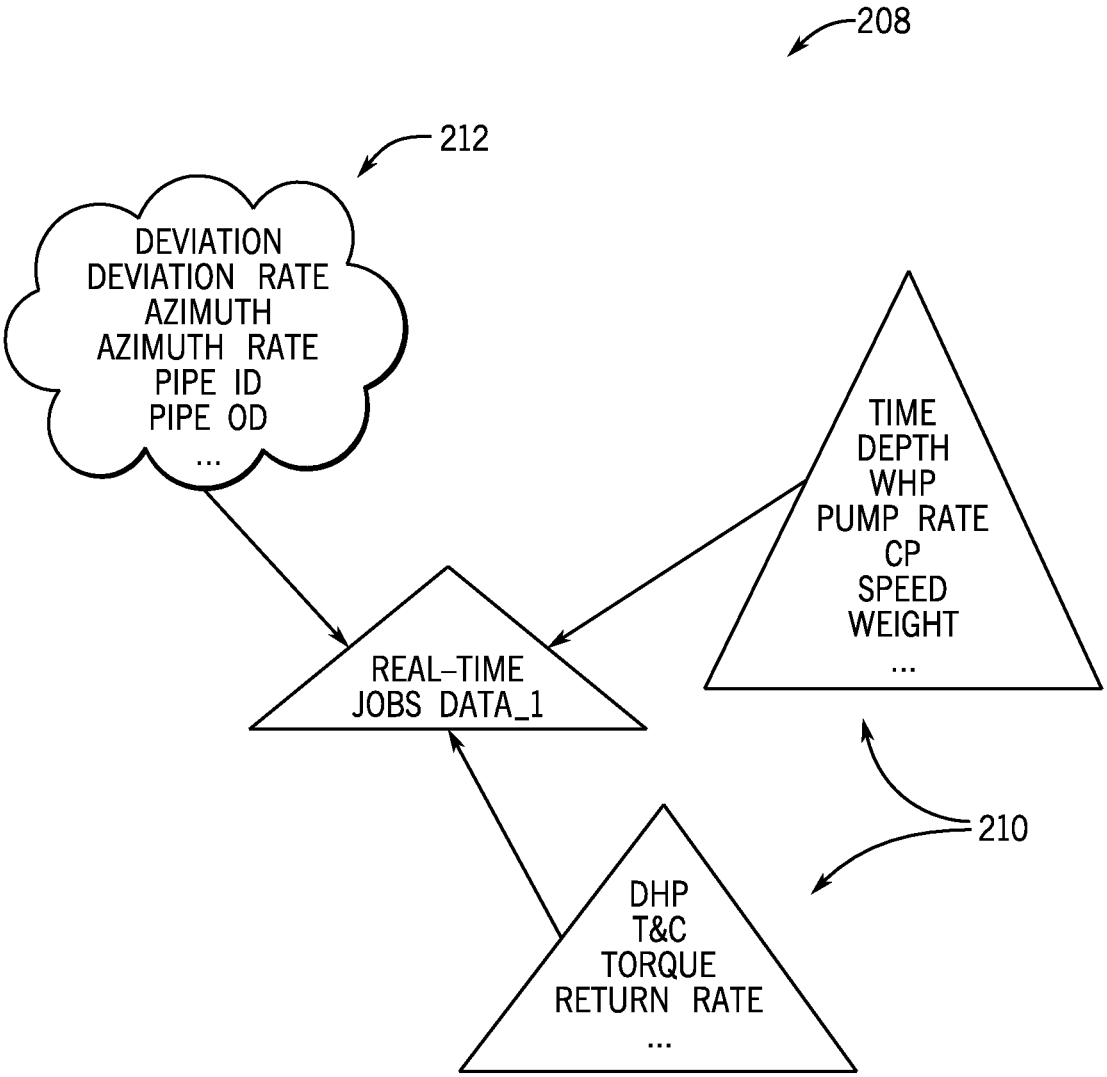
FIG. 15 is a graphical illustration showing real-time updating of coefficient of friction values based on data obtained on the edge during performance of an actual job and based on data previously accumulated or determined, in accordance with embodiments of the present disclosure.

Depending on the operation, the real time job data set may include different data sources and measurements (e.g., both on the edge and in the cloud, for example), as illustrated in the diagram 208 in FIG. 15. Examples of data 210 from real-time data sources may include a variety of edge parameters, such as time, depth, wellhead pressure, pump rate, circulation pressure, speed, weight, downhole pressure, tension and compression measurements, torque measurements, surface return rates, and/or other edge parameter measurements. Examples of data 212 obtained from the cloud (e.g., the cloud storage 58 illustrated in FIG. 4) may include, but is not limited to, wellbore deviation angle, deviation build rate, azimuth angle, azimuth build rate, pipe/tubing inside diameter, pipe/tubing outside diameter, and/or other data obtained from memory. This data may be processed in real time via the surface processing system 50 to continually/periodically update the COF to enable application of appropriate weight of the coiled tubing 20 to achieve an optimized ROP for a given operation.

The embodiments described herein also facilitate operation of the downhole well tool 42 via a combination of real-time data and data based on a priori knowledge. As used herein, the term "a priori" is intended to refer to data that is not based on the downhole sensor data or the surface sensor data, both of which are described herein, or any other data relating to actual operation of the downhole well tool and/or the other equipment described herein, but rather is knowledge that is based on theoretical characteristics and/or operational parameters of operation of the downhole well tool and/or the other equipment described herein. In certain embodiments, the surface processing system 50 may use a priori knowledge of milling targets such as plugs (e.g., a priori configuration knowledge such as depth, vertical height, composition, and so forth) in combination with real-time acquisition of data to infer desired downhole characteristics. For example, the a priori knowledge may be combined with torque data and thrust data (e.g., torque-thrust curve data) to infer the performance and/or condition of the downhole motor 34, the milling tool 36, and/or the milling target (e.g., plug 30) during a milling operation.

The embodiments described herein include obtaining measurements in real-time regarding operation of the downhole well tool 42 with respect to a downhole target, such as a plug 30. In certain embodiments, the real-time data may be used by the surface processing system 50, which processes the data from the measurements (e.g., downhole and/or surface measurements by the downhole and/or surface sensors, respectively) in combination with a priori data to provide information regarding the condition of the downhole well tool 42 and/or the downhole target, such as a plug 30. This information may then be used by the surface processing system 50 to adjust continued operation of the downhole well tool 42 to, for example, prevent relatively poor service quality. In certain embodiments, the surface processing system 50 receives milling tool data (e.g., torque data and the thrust data) from the downhole sensors 48 in substantially real time. In certain embodiments, the surface processing system 50 may be configured to automatically (e.g., without human intervention) correlate a priori knowledge of a plurality of milling targets (e.g., plugs) with real-time torque-thrust curves obtained from the torque data and the thrust data. In certain embodiments, correlations may be used by the surface processing system 50 to determine characteristics of the downhole well tool 42 and/or downhole milling targets (e.g., plugs), which may facilitate continued optimal operation of the downhole well tool 42. It should be noted that, in certain embodiments, continued optimal operation may mean a variety of singular or plural operational conditions. For example, optimal operation may include maximizing a rate of penetration (ROP), milling a precise amount of target material, minimizing unnecessary wear on the milling tool 36, maximizing the useful life of the milling tool 36, minimizing wear of the downhole motor 34, and/or optimizing flow back conditions (e.g., by milling a desirable amount of material at a specific rate and with specific dimensions).

Coiled tubing milling operations presents many operational challenges. Such operational challenges may be related to the type of milling target (e.g., cement, composite bridge plug, through-tubing bridge plug, and so forth). The operational challenges also may relate to the milling target configuration, which may be in the form of several plugs, multiple contiguous targets, or other milling target configurations. Additional operational challenges may be related to controlling the WOB during milling, as well as optimizing an ROP with respect to the milling tool 36 or maximizing the reach of the string of coiled tubing 20.

Many of these challenges have traditionally been problematic, at least in part, because of the limited visibility of downhole conditions in real time. However, the embodiments described herein provide real-time data as well as methods of interpreting that data to obtain actionable information that can be used to address these operational challenges. Additionally, in certain embodiments, the real-time data may be combined with a priori data to obtain improved actionable information, which may be used to adjust operation of the downhole well tool 42 or to make other suitable operational adjustments.

In certain embodiments, the a priori data may include various types of data that are known or derived, and may include milling target number, milling target composition, milling target location (e.g., depth in the wellbore 14), and milling target height. However, the a priori data also may include various operational parameters, such as pump rate (e.g., of the pump unit 64), coiled tubing circulating pressure (e.g., circulating pressure through the coiled tubing 20), coiled tubing downhole circulating pressure (e.g., circulating pressure through the coiled tubing 20 downhole), downhole annular pressure (e.g., pressure between the coiled tubing 20 and the wellbore 14) downhole, differential pressure between the coiled tubing downhole circulating pressure and the annular pressure, and/or other types of known or derived data related to the downhole milling operation or other operation. In certain embodiments, the a priori data also may include other data such as the metal-to-metal friction coefficient, such as the COF described herein. In certain embodiments, the a priori data also may include curves that characterize performance for different combinations of downhole motors 34, mill tools 36, and/or milling targets (e.g., plugs 30) in terms of torque-thrust curves and other downhole parameters. In certain embodiments, the a priori data also may include data (e.g., historical and/or analytical data) about how to optimize for one or more metrics, such as maximizing ROP or maximizing life of the downhole motor 34 and/or milling tool 36, as a function of the different combinations of downhole motors 34, mill tools 36, and/or milling targets (e.g., plugs 30). In addition, in certain embodiments, the a priori data may include knowledge as to how downhole parameters or performance curves are expected to evolve over time as a function of the downhole assembly (e.g., as a function of how the milling tool 36 and/or the downhole motor 34 ages) and as a function of changing conditions (e.g., increasing an amount of cuttings that have been removed from the milling target and deposited on top of the downhole assembly).

In certain embodiments, interpretation of the combined a priori data and real-time data to obtain actionable information may be relatively straightforward (e.g., avoiding a certain measured thrust or torque on the milling tool 36 to avoid a stall of the downhole motor 34). However, other embodiments may utilize more sophisticated data analysis by the surface processing system 50 to detect an event or to evaluate a situation. A non-limiting example of more sophisticated data analysis includes detecting when a milling tool 36 has crossed from one milling target (e.g., plug 30) to another. Detecting when the milling tool 36 has crossed from one milling target to another may be particularly difficult when the milling targets are contiguous, such as when cement is dumped on top of a plug 30.

Other examples of more sophisticated data analysis include identifying if there is an inconsistency within the milling target or if there is a deterioration in the performance of the milling tool 36 or other component of the bottom hole assembly 32. In a milling operation, for example, this type of sophisticated data analysis to obtain actionable information may be achieved by correlating a combination of time-domain milling data (e.g., surface data and/or downhole data), milling target profiles, bit/target performance curves, and torque-thrust curves to address issues such as the composition of what is being milled, whether the milling target has changed, whether the milling tool is underperforming, and so forth. As described in greater detail herein, the surface processing system 50 may facilitate real-time prevention as well as real-time and post-job prognostics. With respect to real-time prevention, the embodiments described herein utilize real-time data to detect when a downhole system is operating close to or beyond an optimal operating envelope for specific downhole equipment. With respect to real-time and post-job prognostics, the embodiments described herein also may utilize real-time data or after the job data to predict that a downhole well tool 42 and/or a milling target is at risk of experiencing operational difficulties. As a result, the embodiments described herein may be used to help implement prognostics health management with respect to downhole well tools 42 and operations.

In certain embodiments, surface processing system 50 may use a priori knowledge of the milling target combined with data obtained in real-time regarding torque-thrust curves of the downhole well tool 42. This combined data may be processed by the surface processing system 50 to infer the performance and/or condition of, for example, the downhole motor 34, the milling tool 36, and/or the milling target. In certain embodiments, the a priori data and real-time data may be processed by the surface processing system 50 via a trainable, intelligent processing system that may then be used by the surface processing system 50 in automating and/or optimizing a decision-making process with respect to adjustments to the downhole operation (e.g., adjustments to the milling tool operation, adjustments to the conveyance of the coiled tubing 20, and/or adjustments to the pumping conditions of the pump unit 64). In certain less automated embodiments, however, the a priori data and real-time data may be processed by the surface processing system 50 and recommendations may be output by the surface processing system 50 to a suitable display (e.g., a "milling advisor" display) to which a coiled tubing operator may refer during the downhole operation. The display may, thus, be used to advise an operator to make certain adjustments with respect to the downhole operation.

It should also be noted that, in certain embodiments, additional a priori knowledge may be provided to the surface processing system 50 to help infer the performance and/or condition of, for example, the downhole motor 34, the milling tool 36, and/or the milling target (e.g., a plug 30). In certain embodiments, the a priori knowledge may be various known or derived data that are stored at a suitable memory location, as described in greater detail herein. By way of example, in certain embodiments, the a priori data may include historical data and/or other useful data related to operational parameters of the milling tool 36 and/or information relating to milling targets. However, in certain embodiments, the a priori data also may include detected or derived data based on operation of the milling tool 36 and/or other equipment, such as pump rate of the pump unit 64, downhole differential pressures, and/or other operational parameters.

In certain embodiments, the sensors 48, 54 may be selected to enable collection of torque data, thrust data, and various other types of data as the milling tool 36 is operated to mill through desired downhole milling targets, such as plugs 30. Depending on the specifics of a given application, various types of data (e.g., torque data and thrust data) may be collected downhole and transmitted to the surface processing system 50 in real time to facilitate improved operation of the milling tool 36. This data also may be used by the surface processing system 50 to fully or partially automate the downhole operation, to optimize the downhole operation, and/or to provide more accurate predictions regarding components or aspects of the downhole operation.

During coiled tubing milling of desired targets, for example, downhole data such as thrust data (e.g., WOB), torque data from a load module associated with the downhole hydraulic motor 34, and pressures (e.g., differential pressures) may be processed via the surface processing system 50. This processed data may then be employed by the surface processing system 50 to control the injector head 62 and/or the pump unit 64 to generate, for example, a faster and more controlled ROP with respect to milling targets. In addition, in certain embodiments, the data may be updated by the surface processing system 50 as the milling tool 36 is moved to different targets and different positions along the wellbore 14 to help optimize milling throughout stages of the operation. The data also enables automation of the milling process (or other process) by the surface processing system 50 through automated controls over the injector head 62 and/or pump unit 64 via control instructions provided by the surface processing system 50.

Figure 16:
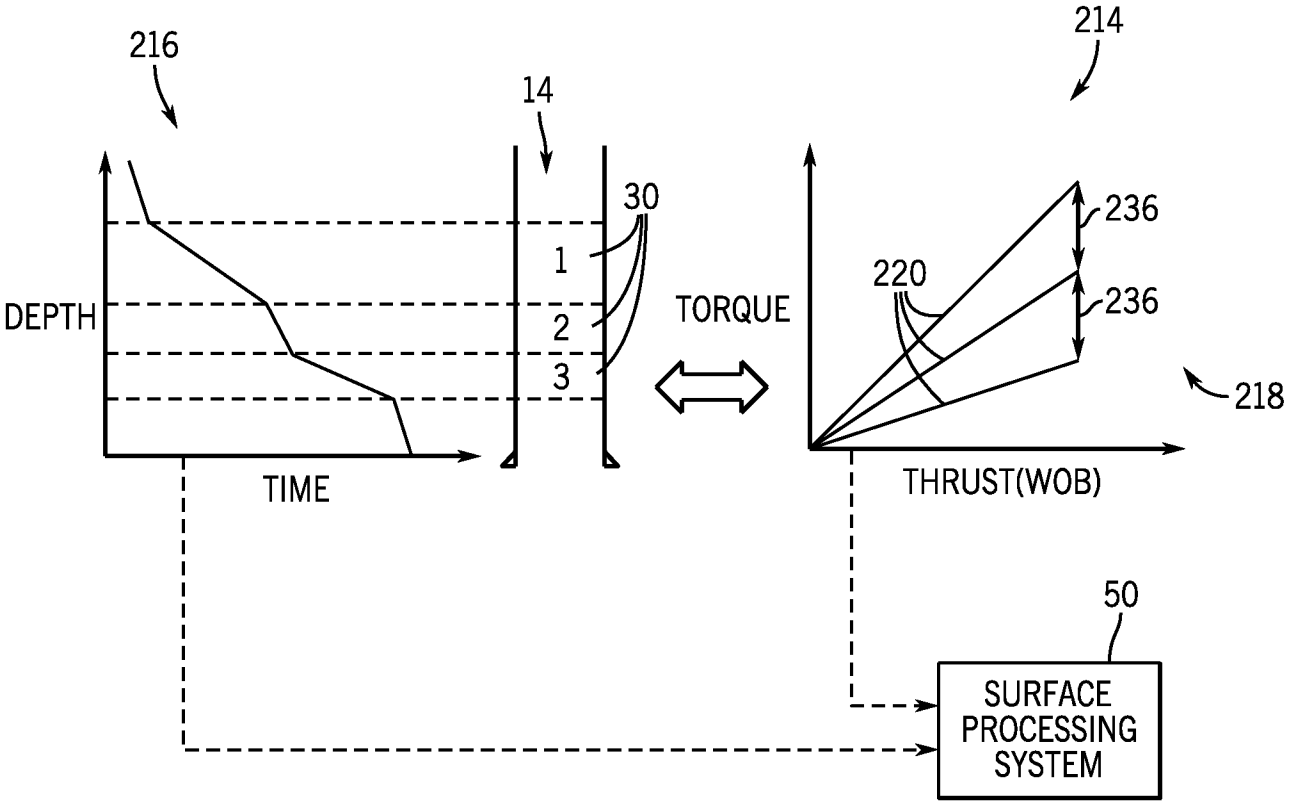
FIG. 16 is a schematic illustration showing the correlation of a priori knowledge of a plurality of milling targets with real-time torque-thrust curves to enable determination of characteristics of a milling operation, in accordance with embodiments of the present disclosure.

In addition, in certain embodiments, real-time data from downhole may be combined by the surface processing system 50 with a priori data to enhance evaluation of the downhole operation. Referring generally to FIG. 16, a diagrammatic illustration 214 is provided of a technique for correlating a priori knowledge of milling targets (e.g., the left side 216 of the diagram 214) with real-time torque/thrust data used to establish torque-thrust curves associated with each of the milling targets (e.g., the right side 218 of the diagram 214). For example, the left side 216 of the diagram 214 illustrates depth versus time for a downhole well tool 42 while a milling tool 36 mills through a plurality of different milling targets (e.g., plugs 30) disposed in a wellbore 14, whereas the right side 218 of the diagram 214 illustrates a chart of torque versus thrust (e.g., WOB) curves. As illustrated in FIG. 16, in certain embodiments, both sets of data may be used by the surface processing system 50 to enhance evaluation of the downhole operation.

For example, in certain embodiments, the surface processing system 50 may process downhole parameters in the form of thrust data and torque data to obtain torque-thrust curves 220 for each milling target (e.g., each plug 30 illustrated in the left side 216 of the diagram 214). By combining a priori data regarding the milling targets (e.g., a priori configuration data such as milling target positions, milling target heights, milling target compositions, and so forth) and the real-time acquisition of the torque-thrust curves 220, the surface processing system 50 may be capable of inferring the performance and/or condition of the milling targets and/or the downhole well tool 42 (e.g., the downhole motor 34 and/or the milling tool 36). In certain embodiments, the surface processing system 50 may be programmed for automated (e.g., without human intervention) decision-making with respect to subsequent activities (e.g., subsequent operations of the downhole well tool 42) with respect to specific milling targets.

In certain embodiments, the torque data, thrust data, and torque-thrust relationships may be used by the surface processing system 50 to identify downhole conditions and/or performance of the downhole well tool 42. For example, in certain embodiments, the torque data and the thrust data may be used by the surface processing system 50 in combination with the a priori data to detect when the milling tool 36 engages a given milling target (e.g., plug 30). In certain embodiments, the torque data and the thrust data also may be used with the a priori data via the surface processing system 50 to detect a change in the integrity of a given milling target (e.g., plug 30). In addition, in certain embodiments, processing of the torque data and the thrust data, along with the a priori information, by the surface processing system 50 enables detection with respect to when the milling tool 36 meets or crosses an interface between two milling targets (e.g., between two contiguous milling targets). Furthermore, in certain embodiments, processing of the torque data and the thrust data, along with the a priori data, by the surface processing system 50 may be used to detect when the milling tool 36 experiences a change in performance (e.g., when the milling tool 36 is underperforming relative to at least one expected operating parameter of the milling tool 36).

In certain embodiments, certain parameters remain relatively constant while the surface processing system 50 determines the torque data, the thrust data, and the torque-thrust curves 220. For example, in certain embodiments, the pump rate of hydraulic fluid being pumped to power the downhole hydraulic motor 34, as well as the downhole differential pressure of the hydraulic fluid within the coiled tubing 20 relative to the hydraulic fluid in the surrounding annulus (e.g., between the coiled tubing 20 and the wellbore 14), may be kept relatively constant to facilitate use of the torque-thrust curves 220 by the surface processing system 50.

In certain embodiments, however, the torque-thrust curves 220 may be held relatively constant by the surface processing system 50 while the other parameters change. This latter approach may be useful in determining various other types of information. As but one non-limiting example, if the downhole motor 34, the milling tool 36, and the milling target perform along established curves and differential pressures increase over an established operating baseline, this is an indication that the downhole motor 34 may be degrading (e.g., rubber may be swelling in a positive displacement downhole motor 34) or the downhole motor 34 may be clogging due to sediments in the coiled tubing 20 and/or fluids being pumped. Regardless, the determination of various combinations and relationships of downhole data is useful in allowing the surface processing system 50 to automatically (e.g., without human intervention) adjust any and all parameters described herein so as to improve (e.g., optimize) performance of a specific downhole operation. In certain embodiments, the relationships between various downhole parameters (e.g., pump rate and differential pressure) and other parameters (e.g., torque data and thrust data) may be used by the surface processing system 50 to establish certain relationships or signatures with respect to milling of specific types of milling targets. Such relationships or signatures may be used by the surface processing system 50 to detect "new" events downhole or new behavior of the downhole equipment, and to learn from deviations with respect to the established relationships or signatures.

As such, the example illustrated in FIG. 16 shows a methodology for using a priori knowledge of milling target (s) (e.g., plug(s) 30) and the real-time acquisition of downhole parameters to infer the condition of the downhole motor 34, the milling tool 36, and/or the milling target(s). The principal data considered and correlated for this task are illustrated in FIG. 16, which shows three targets (e.g., plugs 30) to be milled. According to this example, each milling target (e.g., plug 30) has its own consistent material composition. As opposed to all being plugs 30 as illustrated in FIG. 16, in other embodiments, the three illustrated milling targets may present three distinct milling target types (e.g., cement, composite plug, and through-tubing bridge plug). However, in other embodiments, the three milling targets illustrated in FIG. 16 may also comprise three different layers of one single plug 30 (e.g., upper adapter body, slips, and lower packer element). In certain embodiments, the three milling targets illustrated in FIG. 16 may be separated by a fluid gap, or they may be installed contiguously with their surfaces in direct contact.

By using the a priori knowledge associated with the three milling targets illustrated in FIG. 16, in combination with the torque-thrust curves 220 established via, for example, downhole sensors 48, valuable information may be determined by the surface processing system 50 regarding the milling process with respect to each of these milling targets. Depending on, for example, the torque-thrust curve 220 associated with each milling target, adjustments may be made by the surface processing system 50 to optimize or otherwise affect the milling process.

Figure 17:
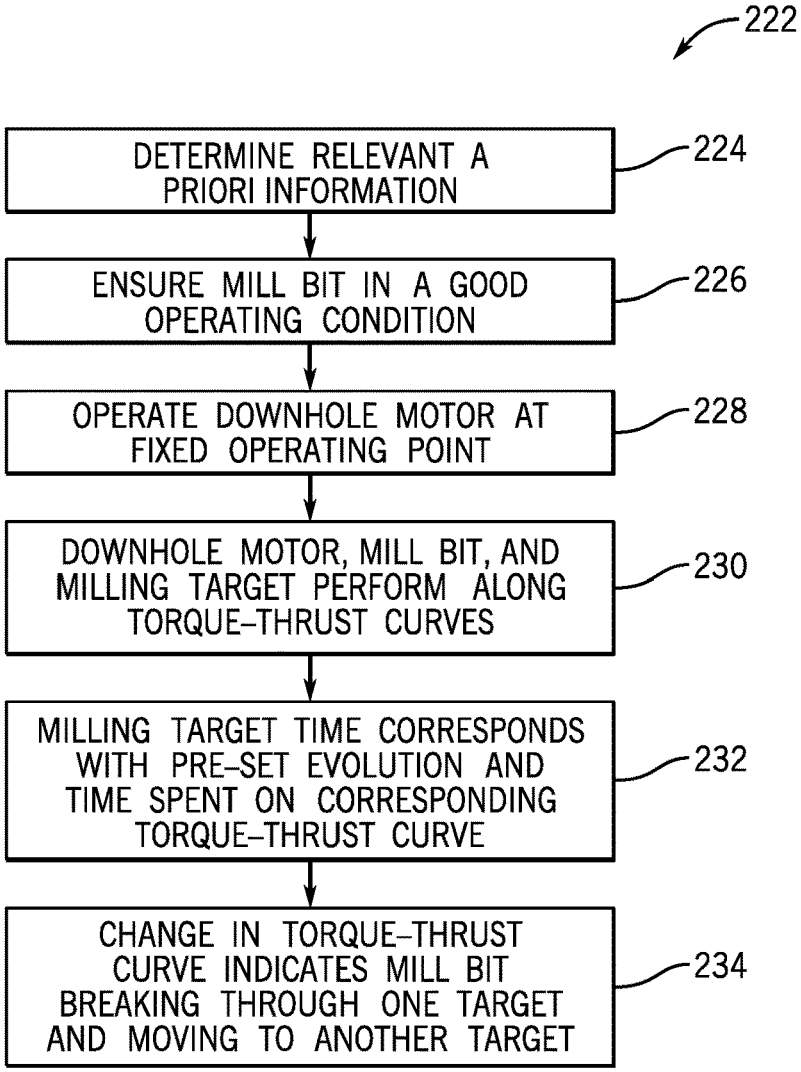
FIG. 17 is a flowchart illustrating an example of a downhole operation (e.g., a milling operation), which utilizes real-time data in combination with data related to a priori knowledge, in accordance with embodiments of the present disclosure.

Referring generally to FIG. 17, a flow chart of a process 222 is provided to illustrate an example of the surface processing system 50 utilizing a priori data and real-time downhole data. In this example, the surface processing system 50 may be employed in conjunction with a milling operation in which three targets are to be milled along a wellbore 14, as illustrated in FIG. 16. Both a priori data and real-time downhole data may be provided to the surface processing system 50 for processing to determine relationships indicative of a corresponding operational condition. For example, downhole thrust data on the milling tool 36 and torque data from the downhole hydraulic motor 34 may be provided in substantially real-time to the surface processing system 50 to enable determination of torque-thrust curves 220, which can be used in conjunction with a priori information to provide various determinations with respect to milling of certain downhole milling targets, as described in greater detail herein.

In the example illustrated in FIG. 17, relevant a priori information may be determined and provided to the surface processing system 50 (block 224). In certain embodiments, the a priori information may include the borehole depth and vertical height of each milling target, as well as the basic compositions of each milling target that are known prior to milling. The milling tool 36 may then be checked by the surface processing system 50 to ensure that the milling tool 36 is in good operating condition (block 226). In this example, it may be assumed by the surface processing system 50 that the milling tool 36 does not deteriorate or change over the span of the particular milling operation.

During milling, the downhole hydraulic motor 34 may be operated by the surface processing system 50 at a fixed operating point (block 228). In certain embodiments, the fixed operating point may result from controlling the fluid flow rate to the downhole hydraulic motor 34 to produce a controlled downhole differential pressure. In certain embodiments, the downhole motor 34, the milling tool 36, and the milling target(s) perform along established torque-thrust curves 220 (block 230) (see also torque-thrust curves 220 in FIG. 16). Examples of the torque-thrust curves 220 may include various power or other relationship trend curves, and in some cases may include linear or semi-linear torque-thrust curves 220. Under these conditions, the time to mill a given target corresponds with pre-set evolution and the time spent on a corresponding torque-thrust curve 220 (block 232).

When the milling tool 36 breaks through one target to another target, the transition or shift corresponds with a change in the torque-thrust curve 220 (block 234). This change is indicated graphically by arrows 236 in FIG. 16. The arrows 236 indicate vertical travel between the subsequent torque-thrust curves 220, and provide a visual indication of "interface detection" as the milling tool 36 moves through the interface between subsequent milling targets. In certain embodiments, the surface processing system 50 receives the torque-thrust data in substantially real-time, and this data may be processed by the surface processing system 50 to output such a corresponding visual indication (or various other types of indications) as the milling tool 36 moves from one milling target to another.

However, if the surface processing system 50 receives other (e.g., changing) torque data and thrust data, the differing data may be used by the surface processing system 50 to determine a different operational condition. If, for example, the downhole motor 34, the milling tool 36, and the milling target(s) do not operate along established torque-thrust curves 220, the surface processing system 50 may be capable of determining a corresponding condition. As indicated at block 230, the downhole motor 34, the milling tool 36, and/or the milling target(s) may not always operate along established torque-thrust curves 220 while otherwise under the same conditions. In other words, the real-time data provided to the surface processing system 50 may indicate that a different condition has occurred.

Figure 18:
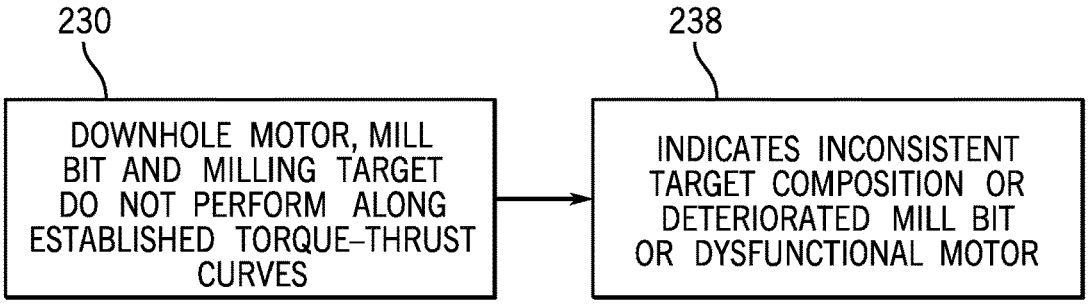
FIG. 18 is a flowchart illustrating another example of a downhole operation (e.g., a milling operation), which utilizes real-time data in combination with data related to a priori knowledge, in accordance with embodiments of the present disclosure.

In this specific situation, as illustrated in FIG. 18, the surface processing system 50 may be suitably programmed and able to determine that either the milling target does not have a consistent composition and/or the downhole motor 34 and/or the milling tool 36 has deteriorated or become dysfunctional (block 238). The inconsistent target composition may result from scale, relatively poor-quality cement, irregular profiles that catch against the milling tool 36, or other inconsistencies. In certain embodiments, further information may be obtained by the surface processing system 50 by processing data on the evolving torque-thrust curves 220 in combination with knowledge as to whether the differential downhole pressures have been affected over the operating range of the downhole motor 34. In certain embodiments, this type of data may be used by the surface processing system 50 to isolate the root cause of the changes in torque-thrust data as, for example, resulting specifically from the downhole motor 34, the milling tool 36, the milling target, or changing downhole conditions (e.g., settling of cuttings). By extension, in certain embodiments, this type of data may be used by the surface processing system 50 to detect when a given downhole operation is close to or beyond an optimal operating envelope with respect to downhole equipment so as to enable prevention of suboptimal performance, as described in greater detail herein. Accordingly, in certain embodiments, the real-time monitoring of downhole and/or surface data in combination with a priori information may be used by the surface processing system 50 to surveil parameters and combinations or relationships between parameters to check whether the downhole system remains within a known or established state. However, in certain embodiments, suitable processing of the data also may be used by the surface processing system 50 to detect deviations of the parameters or parameter relationships, and these deviations may be used by the surface processing system 50 to determine whether the operation is trending towards suboptimal performance.

Figure 19:
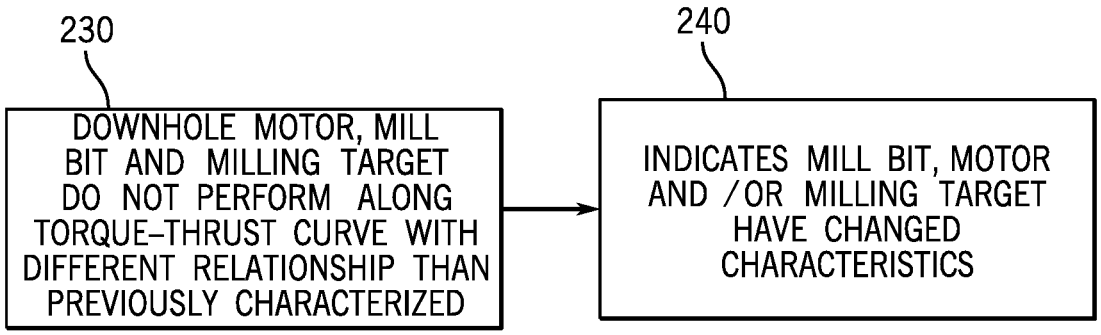
FIG. 19 is a flowchart illustrating another example of a downhole operation (e.g., a milling operation), which utilizes real-time data in combination with data related to a priori knowledge, in accordance with embodiments of the present disclosure.

In another example illustrated in FIG. 19, the downhole motor 34, the milling tool 36, and the milling target(s) operate along different torque-thrust curves 220 than previously characterized (see block 230 in FIG. 19) while otherwise under the same conditions. In this situation, the surface processing system 50 is configured to determine that at least one of the downhole motor 34, the milling tool 36, and/or the milling target have changed characteristics (block 240).

In certain embodiments, the root cause of the change in characteristics may be isolated by the surface processing system 50 by processing data based on the evolving torque-thrust curve 220 in combination with data on the differential downhole pressures. In other words, in certain embodiments, the data may be processed by the surface processing system 50 to determine whether the change in characteristic is resulting from a specific change with respect to the downhole motor 34, the milling tool 36, the milling target, or downhole conditions (e.g., settling of cuttings).

Figure 20:
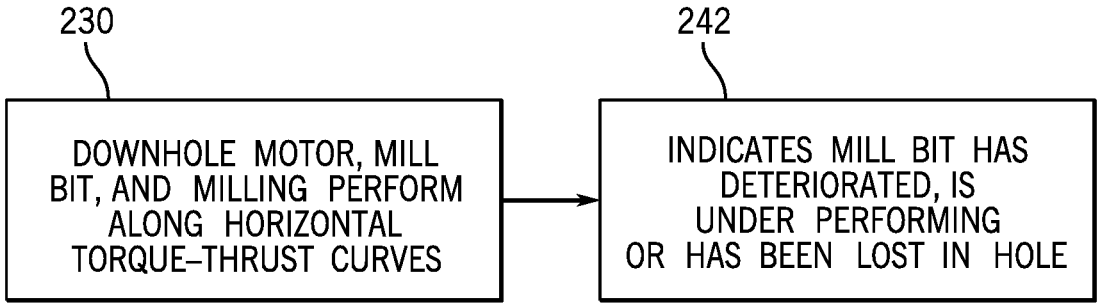
FIG. 20 is a flowchart illustrating another example of a downhole operation (e.g., a milling operation), which utilizes real-time data in combination with data related to a priori knowledge, in accordance with embodiments of the present disclosure.
Figure 21:
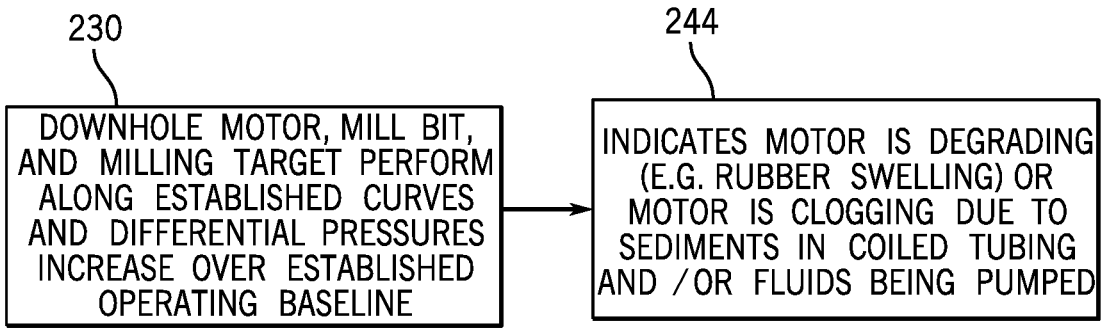
FIG. 21 is a flowchart illustrating another example of a downhole operation (e.g., a milling operation), which utilizes real-time data in combination with data related to a priori knowledge, in accordance with embodiments of the present disclosure.

According to another example illustrated in FIG. 20, the downhole motor 34, the milling tool 36, and the milling target(s) are shown to operate along generally horizontal torque-thrust curves 220. Based on this real-time data, the surface processing system 50 is configured to determine that the milling tool 36 has deteriorated, is underperforming, or has been lost in hole (block 242). In another example illustrated in FIG. 21, the downhole motor 34, the milling tool 36, and the milling target perform along established curves, but differential pressures increase over an established operating baseline (see block 230). Based on this real-time data, the surface processing system 50 is configured to determine a given condition, such as degrading of downhole motor 34 (e.g., rubber swelling in a positive displacement downhole motor 34) or that the downhole motor 34 is clogging due to sediments in the coiled tubing 20 and/or in the fluids being pumped (block 244). These are just a few examples of relationships between various operational conditions and real-time, downhole data that can be established and monitored by the surface processing system 50. In certain embodiments, the relationships may be used by the surface processing system 50 to determine the onset of a given operational condition to, thus, facilitate improved milling operations and/or other downhole operations.

The embodiments described herein provide a system and methodology that enhance the use of specific downhole data (e.g., downhole force/thrust and torque). In certain embodiments, the downhole data may be processed by the surface processing system 50 in substantially real-time to help understand, for example, tool status, bit wear, surrounding environment, and/or other desirable information related to downhole conditions under which a milling operation or other downhole operation is occurring. By determining various relationships between information downhole (along with known a priori information), the downhole data may be processed by the surface processing system 50 to accurately make sense of what is happening downhole and to, thus, enable appropriate action based on that information. In certain embodiments, the surface processing system 50 may be programmed with suitable decision-making logic based on these relationships so that suggested operational changes may be indicated and/or automatically (e.g., without human intervention) implemented by the surface processing system 50.

Use of real-time data from downhole milling processes (or other downhole processes) and the automation of control enables a variety of operational improvements. For example, the embodiments described herein may enable automated indication of expected and unexpected conditions with respect to milling targets. In certain embodiments, automated (e.g., without human intervention) changes to the milling operation may be implemented by the surface processing system 50 to ensure efficient completion of the milling operation. The embodiments described herein also enable use of the surface processing system 50 to provide indications of problems with downhole equipment (e.g., deterioration of the downhole hydraulic motor 34 and/or the milling tool 36). A wide variety of relationships between real-time downhole data and downhole conditions, given a known set of parameters, may be determined by the surface processing system 50 to enhance knowledge of downhole conditions while improving a given downhole operation (e.g., a milling operation). In milling applications, the embodiments described herein may effectively be used by the surface processing system 50 in identifying milling events and performance information using torque-thrust curves 220, for example.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method, comprising:

deploying a milling tool downhole into a wellbore via a coiled tubing string;

obtaining a priori data with respect to a downhole milling target of the milling tool;

detecting downhole data relating to downhole operational parameters and surface data relating to surface operational parameters in substantially real time while the milling tool is downhole;

combining the downhole data and the surface data with the a priori data; and processing the downhole data, the surface data, and the a priori data during operation of the milling tool to control operation of the milling tool and the coiled tubing string with respect to the downhole milling target, wherein processing comprises correlating a priori knowledge of a plurality of the downhole milling targets with substantially real-time torque-thrust curves of the milling tool.

2. The method of claim 1, wherein the downhole operational parameters comprise milling tool torque data and thrust data.

3. The method of claim 1, wherein the processing comprising characterizing a reservoir surrounding the wellbore based at least in part of the downhole operational parameters.

4. The method of claim 1, comprising operating the milling tool by pumping hydraulic fluid down through the coiled tubing string.

5. The method of claim 4, comprising using the milling tool to mill a plurality of downhole milling targets positioned along the wellbore.

6. The method of claim 1, wherein obtaining the a priori data comprises obtaining data relating to a configuration of a plurality of downhole milling targets.

7. The method of claim 6, wherein obtaining the a priori data comprises obtaining data relating to a composition of each downhole milling target.

8. The method of claim 1, comprising operating the milling tool at fixed operating characteristics while detecting the downhole data in substantially real time.

9. The method of claim 1, wherein the processing comprises processing data to detect when the milling tool engages with the downhole milling target.

10. The method of claim 1, wherein the processing comprises processing data to detect when an integrity of the downhole milling target changes.

11. The method of claim 1, wherein the processing comprises processing data to detect when the milling tool has met or crossed an interface between two downhole milling targets.

12. The method of claim 1, wherein the processing comprises processing data to detect when downhole operating conditions exceed an optimal operating envelope.

13. The method of claim 1, wherein the processing comprises processing data to detect when the milling tool experiences a performance change.

14. A method, comprising:

deploying a downhole well tool into a wellbore via coiled tubing;

operating the downhole well tool along the wellbore;

obtaining measurements in substantially real time regarding operation of the downhole well tool with respect to a downhole target by obtaining real-time downhole measurements that include milling tool torque data and thrust data;

using a processing system to process data relating to the measurements of milling tool torque data and thrust data in combination with a priori data to provide information relating to operation of the downhole well tool, wherein the processing system processes the milling tool torque data and thrust data to produce substantially real-time torque-thrust curve data in combination with the a priori data; and using the information provided by the processing system to automatically adjust operating parameters of the downhole well tool.

15. The method of claim 14, wherein the downhole well tool comprises a milling tool for sequentially milling through a plurality of downhole targets disposed along the wellbore.

16. The method of claim 15, wherein the processing comprises characterizing a reservoir surrounding the wellbore based at least in part of the downhole operational parameters.

17. The method of claim 15, wherein the processing comprises using the milling tool torque data and thrust data to detect when the milling tool engages with a downhole milling target of the plurality of downhole targets.

18. The method of claim 15, wherein the processing comprises using the milling tool torque data and thrust data to detect a change in integrity of a downhole milling target of the plurality of downhole targets.

19. The method of claim 15, wherein the processing comprises using the milling tool torque data and thrust data to detect when the milling tool has met or crossed an interface between two downhole milling targets of the plurality of downhole targets.

20. The method of claim 15, wherein the processing comprises using the milling tool torque data and thrust data to detect when the milling tool is underperforming relative to at least one expected operating parameter.

21. A system, comprising:

a coiled tubing string having a milling tool deployed downhole in a wellbore via coiled tubing;

a sensor system configured to obtain torque data and thrust data of the milling tool in substantially real time; and a processing system configured to receive the torque data and the thrust data from the sensor system in substantially real time, and to automatically correlate a priori knowledge of a plurality of milling targets with substantially real-time torque-thrust curves obtained from the torque data and the thrust data.

* * * * *